US011542576B2

(12) United States Patent
Bauger et al.

(10) Patent No.: US 11,542,576 B2
(45) Date of Patent: Jan. 3, 2023

(54) ALUMINIUM EXTRUSION ALLOY SUITABLE FOR ETCHED AND ANODIZED COMPONENTS

(71) Applicant: NORSK HYDRO ASA, Oslo (NO)

(72) Inventors: Øystein Bauger, Trondheim (NO); Oddvin Reiso, Sunndalsøra (NO); Hans Bjerkaas, Lier (NO); Tom Hauge, Førresfjorden (NO); Snorre Kjørstad Fjeldbo, Skedsmokorset (NO)

(73) Assignee: NORSK HYDRO ASA, Oslo (NO)

( * ) Notice: Subject to any disclaimer, the term of this patent is extended or adjusted under 35 U.S.C. 154(b) by 0 days.

(21) Appl. No.: 15/780,304

(22) PCT Filed: Nov. 30, 2016

(86) PCT No.: PCT/EP2016/079257
§ 371 (c)(1),
(2) Date: May 31, 2018

(87) PCT Pub. No.: WO2017/093304
PCT Pub. Date: Jun. 8, 2017

(65) Prior Publication Data

US 2019/0256954 A1 Aug. 22, 2019

(30) Foreign Application Priority Data

Dec. 2, 2015 (NO) ..... 20151653

(51) Int. Cl.
*C22C 21/02* (2006.01)
*C25D 11/04* (2006.01)
(Continued)

(52) U.S. Cl.
CPC ..... *C22C 21/02* (2013.01); *B21C 23/00* (2013.01); *C22C 21/08* (2013.01); *C22F 1/04* (2013.01);
(Continued)

(58) Field of Classification Search
CPC ..... C22C 21/02; C22C 21/08; B21C 23/00; C22F 1/04; C22F 1/043; C22F 1/047; C22F 1/05; C23F 1/36
(Continued)

(56) References Cited

U.S. PATENT DOCUMENTS 3,594,133 A 7/1971 Cote et al.
2002/0112797 A1* 8/2002 Parson ..... C22C 21/08 148/690

FOREIGN PATENT DOCUMENTS

CA 2 251 337 10/1997
JP 3738940 B2 * 1/2006

OTHER PUBLICATIONS

Holme et al., Preferential Grain Etching of AlMgSi(Zn) Model Alloys, Oct. 14, 2010, Journal of the Electrochemical Society, 157 URL: <http://jes.ecsdl.org/content/157/12/C424.full.pdf>, pp. C424-C427 (Year: 2010).*

(Continued)

*Primary Examiner* — Humera N. Sheikh
*Assistant Examiner* — Katherine A Christy
(74) *Attorney, Agent, or Firm* — Wenderoth, Lind & Ponack, L.L.P.

(57) ABSTRACT

Aluminium alloys suitable for etched and anodized components, in particular aluminum extrusion alloys of the types containing Magnesium and Silicon, which after being extruded to any wide variety of forms for different applications such as house buildings and other building applications is subjected to etching in a conventional alkaline etching bath and subsequent anodizing, wherein the relation between Cu and Zn is controlled to avoid preferential grain etching and the ratio of Cu/Zn is below 1.

16 Claims, 20 Drawing Sheets

(51) Int. Cl.

| | |
|---|---|
| ***C22F 1/043*** | (2006.01) |
| ***C23F 1/36*** | (2006.01) |
| ***B21C 23/00*** | (2006.01) |
| ***C22C 21/08*** | (2006.01) |
| ***C22F 1/05*** | (2006.01) |
| ***C22F 1/04*** | (2006.01) |
| ***C22F 1/047*** | (2006.01) |
| *C25D 11/16* | (2006.01) |

(52) U.S. Cl.
CPC ..... *C22F 1/043* (2013.01); *C22F 1/047* (2013.01); *C22F 1/05* (2013.01); *C23F 1/36* (2013.01); *C25D 11/04* (2013.01); *C25D 11/16* (2013.01)

(58) Field of Classification Search
USPC ..... 428/472
See application file for complete search history.

(56) References Cited

OTHER PUBLICATIONS

The Aluminum Association, International Alloy Designations and Chemical Composition Limits for Wrought Aluminum and Wrought Aluminum Alloys, Jan. 2015, URL: <https://www.aluminum.org/sites/default/files/Teal%20Sheets.pdf>, pp. Title, Copyright, Table of Contents, i-iii, 1-32 (Year: 2015).*
Atsuo et al., JP3738940 B2 machine translation, Oct. 19, 1999, entire machine translation (Year: 1999).*
Nedal Aluminium, "Alloy Data Sheet EN-AW6060 [AlMgSi]", Nov. 2017, URL: <https://web.archive.org/web/*/https://www.nedal.com/wp-content/uploads/2017/11/Nedal-alloy-Datasheet-EN-AW-6060.pdf>, entire document (Year: 2017).*
ASM Aerospace Specification Metals Inc., "Aluminum 6063-T6", Oct. 1, 2015, URL:<https://web.archive.org/web/20151001202453/http://asm.matweb.com/search/SpecificMaterial.asp?bassnum=MA6063T6>, entire document (Year: 2015).*
International Search Report dated Feb. 13, 2017 in International Application No. PCT/EP2016/079257.

* cited by examiner

Spangling or galvanizing effect on etched 6063 extrusion

Fig. 14a

| | | | | 25x4 mm | 25x4 mm | 25x4 mm | 25x4 mm | 25x4 mm | 25x4 mm | 25x4 mm | 25x4 mm | 25x4 mm | 25x4 mm | 25x4 mm | 25x4 mm | 25x4 mm | 25x4 mm | 25x4 mm | 25x4 mm | 25x4 mm | 25x4 mm | 25x4 mm | 25x4 mm | cross sectio | cooling |
|---|---|---|---|---|---|---|---|---|---|---|---|---|---|---|---|---|---|---|---|---|---|---|---|---|---|
| Billett diameter | | | Location | A | B | C | D | E | F | G | E | H | B | F | B | B | I | I | J | B | I | B | mm² | |
| Ø (mm) | CAST name | Wt% Zn | Wt% Cu | #1 | #2 | #3 | #4 | #5 | #6 | #7 | #8 | #9 | #10 | #11 | #12 | #13 | #14 | #15 | #16 | #17 | #18 | #19 | | |
| 95 | 2 Low | 0,0098 | 0,0203 | OK | | | | | | | | | | | | | | | | | | | 65x2,9 mm | Air cooled |
| 95 | 2 Med | 0,0515 | 0,0204 | OK | | | | | | | | | | | | | | | | | | | 65x2,9 mm | Air cooled |
| 95 | 2 High | 0,1076 | 0,0207 | PGE | | | | | | | | | | | | | | | | | | | 65x2,9 mm | Air cooled |
| 95 | A | 0,0020 | 0,0010 | OK | | | | | | | | | | | | | | | | | | | 65x2,9 mm | Air cooled |
| 95 | B | 0,0111 | 0,0010 | OK | | | | | | | | | | | | | | | | | | | 65x2,9 mm | Air cooled |
| 95 | C | 0,0194 | 0,0010 | OK | | | | | | | | | | | | | | | | | | | 65x2,9 mm | Air cooled |
| 95 | D | 0,0289 | 0,0010 | OK- | | | | | | | | | | | | | | | | | | | 65x2,9 mm | Air cooled |
| 95 | E | 0,0340 | 0,0010 | PGE | | | | | | | | | | | | | | | | | | | 65x2,9 mm | Air cooled |
| 95 | F | 0,0395 | 0,0011 | PGE | | | | | | | | | | | | | | | | | | | 65x2,9 mm | Air cooled |
| 95 | G | 0,0485 | 0,0011 | PGE | | | | | | | | | | | | | | | | | | | 65x2,9 mm | Air cooled |
| 95 | A | 0,0020 | 0,0010 | | OK | OK | OK | OK | OK | OK | OK | OK | OK | OK | OK | OK | OK | OK | OK | OK | OK | OK | 25x4 mm | Air cooled |
| 95 | B | 0,0111 | 0,0010 | | OK | OK | OK | OK | OK | OK | OK | OK | OK | OK | OK | OK | OK | OK | OK | OK | OK | OK | 25x4 mm | Air cooled |
| 95 | C | 0,0194 | 0,0010 | | OK | OK | OK | OK | OK | OK | OK | OK | OK | OK | OK | OK | OK | OK | OK | OK | OK | OK | 25x4 mm | Air cooled |
| 95 | D | 0,0289 | 0,0010 | | OK- | OK- | OK- | OK- | OK- | PGE | OK- | OK- | OK- | OK- | OK- | PGE | OK | OK- | OK | OK- | OK | OK- | 25x4 mm | Air cooled |
| 95 | E | 0,0340 | 0,0010 | | PGE | PGE | PGE | PGE | PGE | PGE | PGE | OK- | PGE | PGE | PGE | PGE | PGE | OK- | OK | PGE | OK- | PGE | 25x4 mm | Air cooled |
| 95 | F | 0,0395 | 0,0011 | | PGE | PGE | PGE | PGE | PGE | PGE | PGE | PGE | PGE | PGE | PGE | PGE | PGE | PGE | OK | PGE | PGE | PGE | 25x4 mm | Air cooled |
| 95 | G | 0,0485 | 0,0011 | | PGE | PGE | PGE | PGE | PGE | PGE | PGE | PGE | PGE | PGE | PGE | PGE | PGE | PGE | OK- | PGE | PGE | PGE | 25x4 mm | Air cooled |
| (203) ⩾ 95 | GWA | 0,0545 | 0,0498 | | | | | | | | | | OK | OK- | OK | OK | OK | OK | OK | OK- | OK | OK | 25x4 mm | Air cooled |
| 95 | A-1 | 0,0219 | 0,0008 | | | | | | | | | | | OK | | | | | | | | | 25x4 mm | Air cooled |
| 95 | A-2 | 0,0311 | 0,0008 | | | | | | | | | | | PGE | | | | | | | | | 25x4 mm | Air cooled |
| 95 | A-3 | 0,0314 | 0,0008 | | | | | | | | | | | PGE | | | | | | | | | 25x4 mm | Air cooled |
| 95 | A-4 | 0,0316 | 0,0007 | | | | | | | | | | | PGE | OK | OK | OK | OK | OK | | | | 25x4 mm | Air cooled |
| 95 | A-5 | 0,0316 | 0,0008 | | | | | | | | | | | OK- | | | | | | | | | 25x4 mm | Air cooled |
| 95 | A-6 | 0,0411 | 0,0008 | | | | | | | | | | | PGE | | | | | | | | | 25x4 mm | Air cooled |
| 95 | A-7 | 0,0429 | 0,0007 | | | | | | | | | | | PGE | | | | | | | | | 25x4 mm | Air cooled |
| 95 | A-8 | 0,0518 | 0,0007 | | | | | | | | | | | PGE | | | | | | | | | 25x4 mm | Air cooled |
| 95 | A-9 | 0,0525 | 0,0007 | | | | | | | | | | | PGE | | | | | | | | | 25x4 mm | Air cooled |
| 95 | A-10 | 0,0515 | 0,0007 | | | | | | | | | | | PGE | PGE | PGE | PGE | PGE | OK | | | | 25x4 mm | Air cooled |
| 95 | A-11 | 0,0514 | 0,0489 | | | | | | | | | | | OK | OK | OK | OK | OK | OK | | | | 25x4 mm | Air cooled |
| 95 | A-12 | 0,0746 | 0,0493 | | | | | | | | | | | PGE | | | | | | | | | 25x4 mm | Air cooled |
| 95 | A-13 | 0,0533 | 0,0009 | | | | | | | | | | | PGE | | | | | | | | | 25x4 mm | Air cooled |
| 95 | A-14 | 0,0620 | 0,0009 | | | | | | | | | | | PGE | | | | | | | | | 25x4 mm | Air cooled |
| 95 | A-15 | 0,0736 | 0,0009 | | | | | | | | | | | PGE | | | | | | | | | 25x4 mm | Air cooled |
| 95 | A-16 | 0,0735 | 0,0009 | | | | | | | | | | | PGE | | | | | | | | | 25x4 mm | Air cooled |
| 95 | B-1 | 0,0308 | 0,0101 | | | | | | | | | | | | OK | OK | OK | OK | OK | | | | 25x4 mm | Air cooled |
| 95 | B-2 | 0,0308 | 0,0196 | | | | | | | | | | | | OK | OK | OK | OK | OK | | | | 25x4 mm | Air cooled |

Continuation of Fig. 14a

| | | | | | | | | | | | | | | | | | | | | | | | | | |
|---|---|---|---|---|---|---|---|---|---|---|---|---|---|---|---|---|---|---|---|---|---|---|---|---|---|
| 95 | B-3 | 0,0308 | 0,0298 | | | | | | | | | | | | OK | OK | OK | OK | OK | | | | 25x4 mm | Air cooled |
| 95 | B-4 | 0,0308 | 0,0401 | | | | | | | | | | | | OK- | OK- | OK | OK | OK | | | | 25x4 mm | Air cooled |
| 95 | B-5 | 0,0310 | 0,0504 | | | | | | | | | | | | OK- | PGE | OK | OK | OK | | | | 25x4 mm | Air cooled |
| 95 | B-6 | 0,0409 | 0,0103 | | | | | | | | | | | | OK | OK | OK | OK | OK | OK | OK | OK | 25x4 mm | Air cooled |
| 95 | B-7 | 0,0407 | 0,0202 | | | | | | | | | | | | OK | OK | OK | OK | OK | OK | OK | OK | 25x4 mm | Air cooled |
| 95 | B-8 | 0,0407 | 0,0298 | | | | | | | | | | | | OK | OK | OK | OK | OK | OK | OK | OK | 25x4 mm | Air cooled |
| 95 | B-9 | 0,0407 | 0,0393 | | | | | | | | | | | | OK | OK- | OK | OK | OK | | | | 25x4 mm | Air cooled |
| 95 | B-10 | 0,0398 | 0,0481 | | | | | | | | | | | | OK | PGE | OK | OK | OK | | | | 25x4 mm | Air cooled |
| 95 | B-11 | 0,0489 | 0,0102 | | | | | | | | | | | | OK | OK | PGE | OK | OK | | | | 25x4 mm | Air cooled |
| 95 | B-12 | 0,0496 | 0,0194 | | | | | | | | | | | | OK | OK | OK | OK | OK | | | | 25x4 mm | Air cooled |
| 95 | B-13 | 0,0496 | 0,0294 | | | | | | | | | | | | OK | OK | OK | OK | OK | | | | 25x4 mm | Air cooled |
| 95 | B-14 | 0,0495 | 0,0391 | | | | | | | | | | | | OK | OK | OK | OK | OK | | | | 25x4 mm | Air cooled |
| 95 | B-15 | 0,0498 | 0,0496 | | | | | | | | | | | | OK | OK | OK | OK | OK | | | | 25x4 mm | Air cooled |
| 95 | A 01-2 | 0,0401 | 0,0049 | | | | | | | | | | | | | | | | | OK | OK | OK | 25x4 mm | Air cooled |
| 95 | 1 A-2 | 0,0383 | 0,0010 | | | | | | | | | | | | | | | | | PGE | OK | OK- | 25x4 mm | Air cooled |
| 95 | 2 E-2 | 0,0592 | 0,0373 | | | | | | | | | | | | | | | | | OK | OK | OK | 25x4 mm | Air cooled |
| 95 | 2 D-2 | 0,0604 | 0,0278 | | | | | | | | | | | | | | | | | OK | OK | OK | 25x4 mm | Air cooled |
| 95 | 2 C-2 | 0,0590 | 0,0187 | | | | | | | | | | | | | | | | | OK | OK | OK | 25x4 mm | Air cooled |
| 95 | 2 B-2 | 0,0591 | 0,0096 | | | | | | | | | | | | | | | | | OK | OK- | OK | 25x4 mm | Air cooled |
| 95 | A 02-2 | 0,0593 | 0,0049 | | | | | | | | | | | | | | | | | PGE | PGE | PGE | 25x4 mm | Air cooled |
| 95 | 2 A-2 | 0,0580 | 0,0010 | | | | | | | | | | | | | | | | | PGE | PGE | PGE | 25x4 mm | Air cooled |
| 95 | 3 F-2 | 0,0806 | 0,0471 | | | | | | | | | | | | | | | | | OK | OK- | OK | 25x4 mm | Air cooled |
| 95 | 3 E-2 | 0,0791 | 0,0378 | | | | | | | | | | | | | | | | | OK | PGE | OK | 25x4 mm | Air cooled |
| 95 | 3 D-2 | 0,0793 | 0,0284 | | | | | | | | | | | | | | | | | OK | PGE | OK | 25x4 mm | Air cooled |
| 95 | 3 C-2 | 0,0801 | 0,0196 | | | | | | | | | | | | | | | | | OK | PGE | OK | 25x4 mm | Air cooled |
| 95 | 3 B-2 | 0,0799 | 0,0102 | | | | | | | | | | | | | | | | | PGE | PGE | PGE | 25x4 mm | Air cooled |
| 95 | A 03-2 | 0,0803 | 0,0050 | | | | | | | | | | | | | | | | | PGE | PGE | PGE | 25x4 mm | Air cooled |
| 95 | 3 A-2 | 0,0799 | 0,0010 | | | | | | | | | | | | | | | | | PGE | PGE | PGE | 25x4 mm | Air cooled |
| 95 | 4 E-2 | 0,0976 | 0,0378 | | | | | | | | | | | | | | | | | OK | PGE | OK | 25x4 mm | Air cooled |
| 95 | 4 D-2 | 0,0972 | 0,0285 | | | | | | | | | | | | | | | | | OK | PGE | OK | 25x4 mm | Air cooled |
| 95 | 4 C-2 | 0,0981 | 0,0194 | | | | | | | | | | | | | | | | | OK | PGE | OK- | 25x4 mm | Air cooled |
| 95 | 4 B-2 | 0,0979 | 0,0102 | | | | | | | | | | | | | | | | | PGE | PGE | PGE | 25x4 mm | Air cooled |
| 95 | A 04-2 | 0,0996 | 0,0051 | | | | | | | | | | | | | | | | | PGE | PGE | PGE | 25x4 mm | Air cooled |
| 95 | 4 A-2 | 0,0974 | 0,0011 | | | | | | | | | | | | | | | | | PGE | PGE | PGE | 25x4 mm | Air cooled |
| 203 | ch 118192 | 0,0061 | 0,0027 | | | | | | | | | | | | | | | | | | | ok | 60x10 mm | Water Q |
| 203 | ch 115258 | 0,0550 | 0,0216 | | | | | | | | | | | | | | | | | | | ok | 60x10 mm | Water Q |
| 203 | ch 115254 | 0,0312 | 0,0215 | | | | | | | | | | | | | | | | | | | ok | 60x10 mm | Water Q |
| 203 | ch 115232 | 0,0309 | 0,0093 | | | | | | | | | | | | | | | | | | | ok | 60x10 mm | Water Q |
| 203 | ch 115227 | 0,0392 | 0,0169 | | | | | | | | | | | | | | | | | | | ok | 60x10 mm | Water Q |
| 203 | ch 115226 | 0,0603 | 0,0113 | | | | | | | | | | | | | | | | | | | ok | 60x10 mm | Water Q |

Fig. 14b

| | Zn | Cu | Fe | Si | Mg | Mn | Ti |
|---|---|---|---|---|---|---|---|
| CAST name | Wt% | Wt% | Wt% | Wt% | Wt% | Wt% | Wt% |
| 2 Low | 0,0098 | 0,0203 | 0,2196 | 0,4614 | 0,4866 | 0,0272 | 0,0083 |
| 2 Med | 0,0515 | 0,0204 | 0,2198 | 0,4642 | 0,4864 | 0,0274 | 0,0121 |
| 2 High | 0,1076 | 0,0207 | 0,2249 | 0,4673 | 0,4872 | 0,0279 | 0,0101 |
| A | 0,0020 | 0,0010 | 0,1543 | 0,4405 | 0,3789 | 0,0487 | 0,0206 |
| B | 0,0111 | 0,0010 | 0,1551 | 0,4415 | 0,3796 | 0,0487 | 0,0101 |
| C | 0,0194 | 0,0010 | 0,1569 | 0,4425 | 0,3812 | 0,0489 | 0,0090 |
| D | 0,0289 | 0,0010 | 0,1581 | 0,4401 | 0,3771 | 0,0485 | 0,0259 |
| E | 0,0340 | 0,0010 | 0,1602 | 0,4403 | 0,3779 | 0,0489 | 0,0151 |
| F | 0,0395 | 0,0011 | 0,1601 | 0,4403 | 0,3772 | 0,0490 | 0,0183 |
| G | 0,0485 | 0,0011 | 0,1650 | 0,4416 | 0,3783 | 0,0491 | 0,0218 |
| A | 0,0020 | 0,0010 | 0,1543 | 0,4405 | 0,3789 | 0,0487 | 0,0206 |
| B | 0,0111 | 0,0010 | 0,1551 | 0,4415 | 0,3796 | 0,0487 | 0,0101 |
| C | 0,0194 | 0,0010 | 0,1569 | 0,4425 | 0,3812 | 0,0489 | 0,0090 |
| D | 0,0289 | 0,0010 | 0,1581 | 0,4401 | 0,3771 | 0,0485 | 0,0259 |
| E | 0,0340 | 0,0010 | 0,1602 | 0,4403 | 0,3779 | 0,0489 | 0,0151 |
| F | 0,0395 | 0,0011 | 0,1601 | 0,4403 | 0,3772 | 0,0490 | 0,0183 |
| G | 0,0485 | 0,0011 | 0,1650 | 0,4416 | 0,3783 | 0,0491 | 0,0218 |
| GWA | 0,0545 | 0,0498 | 0,2933 | 0,4689 | 0,3648 | 0,0573 | 0,0188 |
| A-1 | 0,0219 | 0,0008 | 0,2200 | 0,4895 | 0,3660 | 0,0592 | 0,0203 |
| A-2 | 0,0311 | 0,0008 | 0,2216 | 0,4875 | 0,3635 | 0,0585 | 0,0270 |
| A-3 | 0,0314 | 0,0008 | 0,2699 | 0,4877 | 0,3634 | 0,0591 | 0,0339 |
| A-4 | 0,0316 | 0,0007 | 0,3116 | 0,4682 | 0,3514 | 0,0593 | 0,0241 |
| A-5 | 0,0316 | 0,0008 | 0,3684 | 0,4653 | 0,3493 | 0,0595 | 0,0305 |
| A-6 | 0,0411 | 0,0008 | 0,3707 | 0,4671 | 0,3493 | 0,0596 | 0,0239 |
| A-7 | 0,0429 | 0,0007 | 0,2021 | 0,4576 | 0,3504 | 0,0578 | 0,0225 |
| A-8 | 0,0518 | 0,0007 | 0,2033 | 0,4589 | 0,3514 | 0,0583 | 0,0237 |
| A-9 | 0,0525 | 0,0007 | 0,2494 | 0,4579 | 0,3508 | 0,0586 | 0,0336 |
| A-10 | 0,0515 | 0,0007 | 0,3049 | 0,4647 | 0,3542 | 0,0579 | 0,0283 |
| A-11 | 0,0514 | 0,0489 | 0,3079 | 0,4663 | 0,3534 | 0,0580 | 0,0242 |
| A-12 | 0,0746 | 0,0493 | 0,3578 | 0,4735 | 0,3582 | 0,0590 | 0,0343 |
| A-13 | 0,0533 | 0,0009 | 0,3603 | 0,4658 | 0,3633 | 0,0605 | 0,0280 |
| A-14 | 0,0620 | 0,0009 | 0,3590 | 0,4622 | 0,3601 | 0,0600 | 0,0210 |
| A-15 | 0,0736 | 0,0009 | 0,3592 | 0,4608 | 0,3583 | 0,0600 | 0,0175 |
| A-16 | 0,0735 | 0,0009 | 0,3583 | 0,4587 | 0,3537 | 0,1166 | 0,0208 |
| B-1 | 0,0308 | 0,0101 | 0,2778 | 0,4554 | 0,3586 | 0,0617 | 0,0334 |
| B-2 | 0,0308 | 0,0196 | 0,2765 | 0,4525 | 0,3561 | 0,0612 | 0,0371 |
| B-3 | 0,0308 | 0,0298 | 0,2812 | 0,4584 | 0,3569 | 0,0613 | 0,0338 |
| B-4 | 0,0308 | 0,0401 | 0,2833 | 0,4590 | 0,3554 | 0,0616 | 0,0297 |
| B-5 | 0,0310 | 0,0504 | 0,2816 | 0,4573 | 0,3532 | 0,0618 | 0,0280 |
| B-6 | 0,0409 | 0,0103 | 0,2613 | 0,4605 | 0,3491 | 0,0623 | 0,0378 |
| B-7 | 0,0407 | 0,0202 | 0,2627 | 0,4585 | 0,3473 | 0,0619 | 0,0294 |
| B-8 | 0,0407 | 0,0298 | 0,2649 | 0,4598 | 0,3456 | 0,0618 | 0,0336 |
| B-9 | 0,0407 | 0,0393 | 0,2671 | 0,4592 | 0,3440 | 0,0617 | 0,0316 |
| B-10 | 0,0398 | 0,0481 | 0,2614 | 0,4470 | 0,3341 | 0,0619 | 0,0362 |
| B-11 | 0,0489 | 0,0102 | 0,2770 | 0,4613 | 0,3561 | 0,0603 | 0,0461 |
| B-12 | 0,0496 | 0,0194 | 0,2754 | 0,4586 | 0,3548 | 0,0600 | 0,0354 |
| B-13 | 0,0496 | 0,0294 | 0,2759 | 0,4589 | 0,3554 | 0,0608 | 0,0310 |
| B-14 | 0,0495 | 0,0391 | 0,2782 | 0,4585 | 0,3534 | 0,0603 | 0,0391 |
| B-15 | 0,0498 | 0,0496 | 0,2800 | 0,4563 | 0,3511 | 0,0608 | 0,0335 |
| A 01-2 | 0,0401 | 0,0049 | 0,2466 | 0,4554 | 0,3501 | 0,0576 | 0,0147 |
| 1 A-2 | 0,0383 | 0,0010 | 0,2193 | 0,4554 | 0,3488 | 0,0575 | 0,0192 |
| 2 E-2 | 0,0592 | 0,0373 | 0,2333 | 0,4678 | 0,3374 | 0,0591 | 0,0119 |
| 2 D-2 | 0,0604 | 0,0278 | 0,2278 | 0,4658 | 0,3386 | 0,0592 | 0,0112 |
| 2 C-2 | 0,0590 | 0,0187 | 0,2276 | 0,4634 | 0,3366 | 0,0585 | 0,0199 |
| 2 B-2 | 0,0591 | 0,0096 | 0,2296 | 0,4623 | 0,3385 | 0,0588 | 0,0123 |
| A 02-2 | 0,0593 | 0,0049 | 0,2405 | 0,4547 | 0,3495 | 0,0576 | 0,0148 |
| 2 A-2 | 0,0580 | 0,0010 | 0,2234 | 0,4597 | 0,3494 | 0,0576 | 0,0174 |
| 3 F-2 | 0,0806 | 0,0471 | 0,2263 | 0,4738 | 0,3540 | 0,0596 | 0,0116 |
| 3 E-2 | 0,0791 | 0,0378 | 0,2270 | 0,4726 | 0,3547 | 0,0595 | 0,0160 |
| 3 D-2 | 0,0793 | 0,0284 | 0,2286 | 0,4739 | 0,3557 | 0,0596 | 0,0177 |
| 3 C-2 | 0,0801 | 0,0196 | 0,2266 | 0,4749 | 0,3572 | 0,0597 | 0,0071 |
| 3 B-2 | 0,0799 | 0,0102 | 0,2288 | 0,4740 | 0,3574 | 0,0594 | 0,0122 |
| A 03-2 | 0,0803 | 0,0050 | 0,2472 | 0,4603 | 0,3521 | 0,0585 | 0,0082 |
| 3 A-2 | 0,0799 | 0,0010 | 0,2246 | 0,4740 | 0,3578 | 0,0590 | 0,0120 |
| 4 E-2 | 0,0976 | 0,0378 | 0,2506 | 0,4649 | 0,3530 | 0,0585 | 0,0104 |
| 4 D-2 | 0,0972 | 0,0285 | 0,2530 | 0,4669 | 0,3571 | 0,0597 | 0,0109 |
| 4 C-2 | 0,0981 | 0,0194 | 0,2518 | 0,4656 | 0,3564 | 0,0588 | 0,0068 |
| 4 B-2 | 0,0979 | 0,0102 | 0,2539 | 0,4673 | 0,3579 | 0,0590 | 0,0109 |
| A 04-2 | 0,0996 | 0,0051 | 0,2473 | 0,4658 | 0,3539 | 0,0589 | 0,0147 |
| 4 A-2 | 0,0974 | 0,0011 | 0,2529 | 0,4657 | 0,3577 | 0,0591 | 0,0137 |
| ch 118192 | 0,0061 | 0,0027 | 0,19252 | 0,4572 | 0,3695 | 0,0423 | 0,0091 |
| ch 115258 | 0,0550 | 0,0216 | 0,24409 | 0,4593 | 0,3721 | 0,0595 | 0,0088 |
| ch 115254 | 0,0312 | 0,0215 | 0,24182 | 0,4596 | 0,3745 | 0,0589 | 0,0081 |
| ch 115232 | 0,0309 | 0,0093 | 0,24358 | 0,4606 | 0,3783 | 0,0593 | 0,0087 |
| ch 115227 | 0,0392 | 0,0169 | 0,24293 | 0,4565 | 0,3912 | 0,0589 | 0,0097 |
| ch 115226 | 0,0503 | 0,0113 | 0,23787 | 0,4561 | 0,3923 | 0,0599 | 0,0094 |

Fig. 15
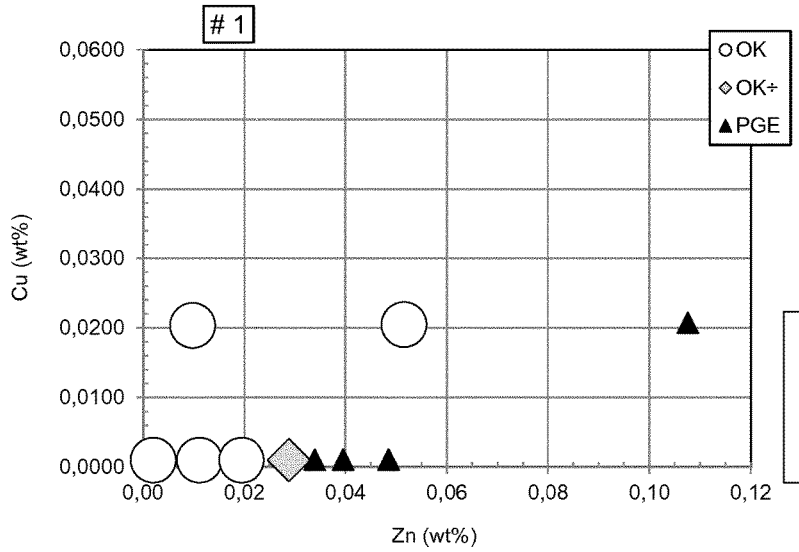
Figure 15
Trial 1
Site A
Ø95 mm billets
Profile cross section: 2,9 x 65 mm²
Fig. 16
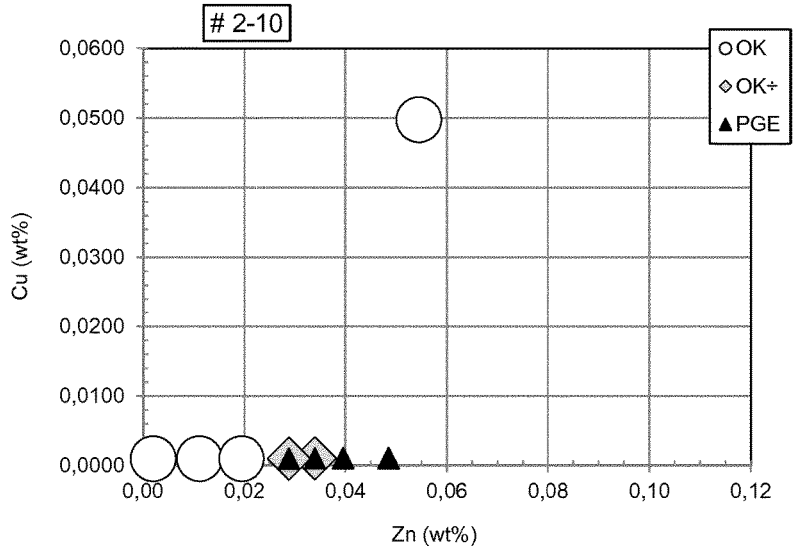
Figure 16
Trial 2 – 10
(Site B-H)
Ø95 mm billets
Profile cross section: 4 x 25 mm²
The points along the X-axis are from 8 comparative bench-mark trials with no Cu in the alloys.
The point with 0,05%Cu is from one single trial with a sample machined to Ø95 mm from a Ø203 mm billet.

Fig. 17
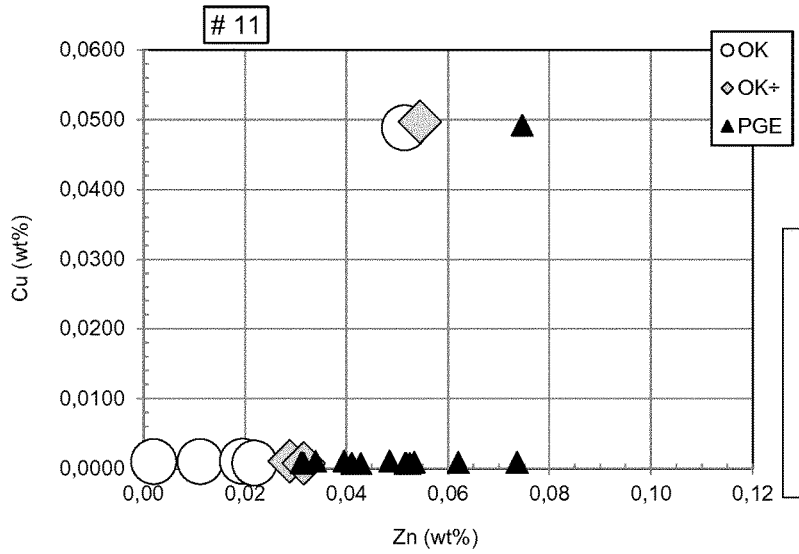
Figure 17
Trial 11
(Site F)
Ø95 mm billets
Profile cross section: 4 x 25 mm²
Results from trials with mainly varying the Fe-content.
Fig. 18
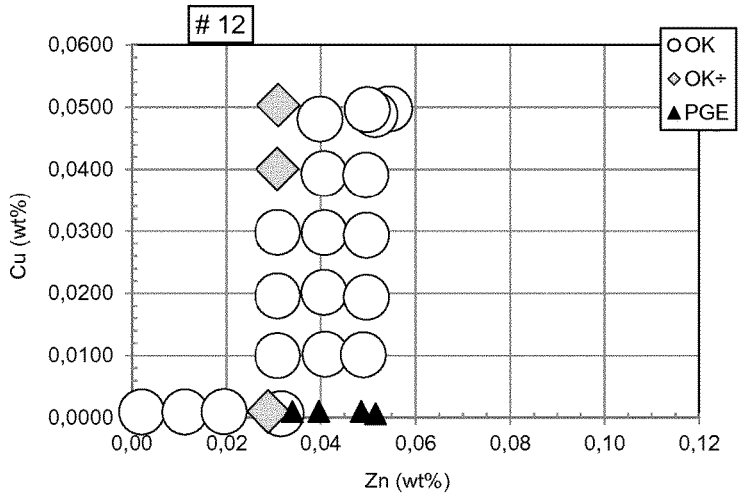
Figure 18
Trial 12
(Site B)
Ø95 mm billets
Profile cross section: 4 x 25 mm²
Results from trials with mainly varying the Zn- and Cu.

Fig. 21
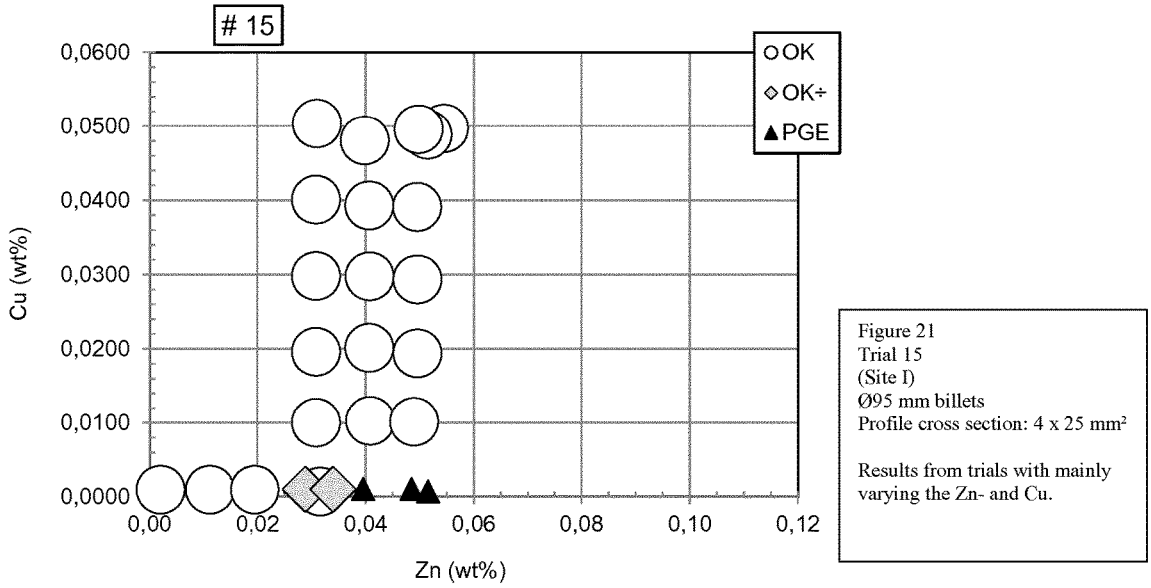
Figure 21
Trial 15
(Site I)
Ø95 mm billets
Profile cross section: 4 x 25 mm²
Results from trials with mainly varying the Zn- and Cu.
Fig. 22
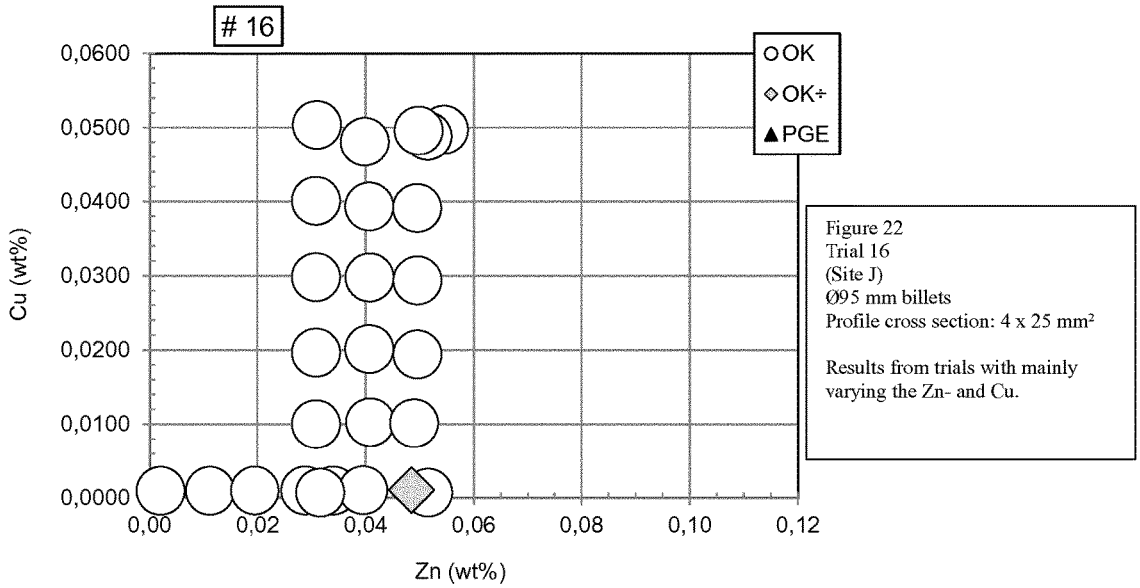
Figure 22
Trial 16
(Site J)
Ø95 mm billets
Profile cross section: 4 x 25 mm²
Results from trials with mainly varying the Zn- and Cu.

Fig. 23
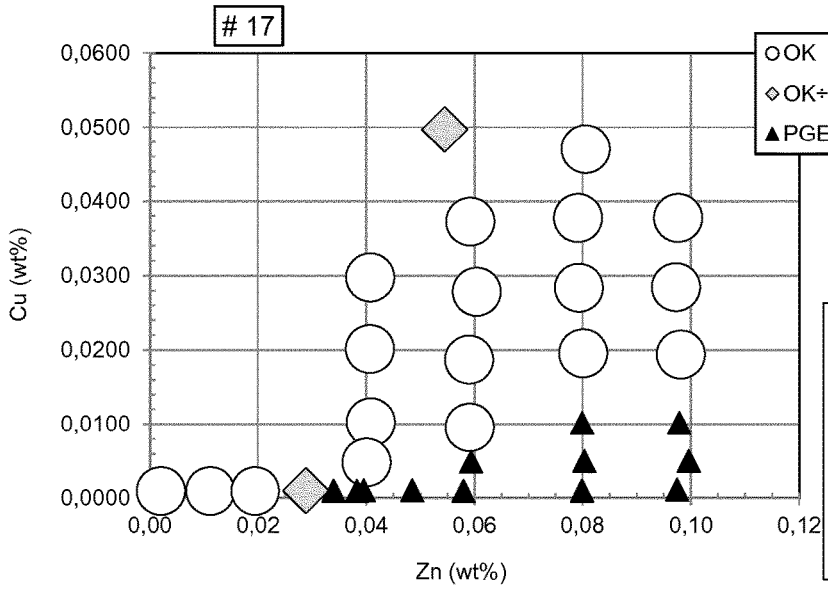
Figure 23
Trial 17
(Site B)
Ø95 mm billets
Profile cross section: 4 x 25 mm²
Results from trials with mainly varying the Zn- and Cu.
Fig. 24
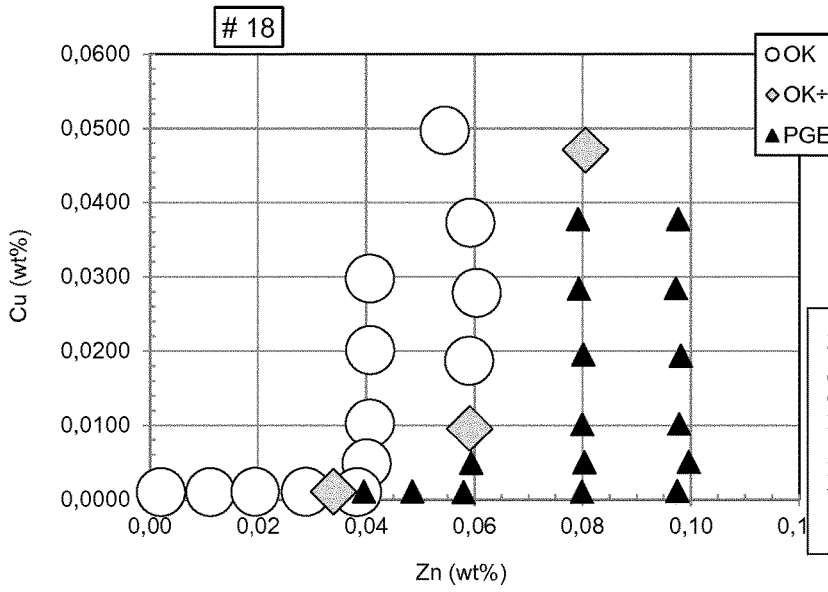
Figure 24
Trial 18
(Site I)
Ø95 mm billets
Profile cross section: 4 x 25 mm²
Results from trials with mainly varying the Zn- and Cu.

Fig. 25

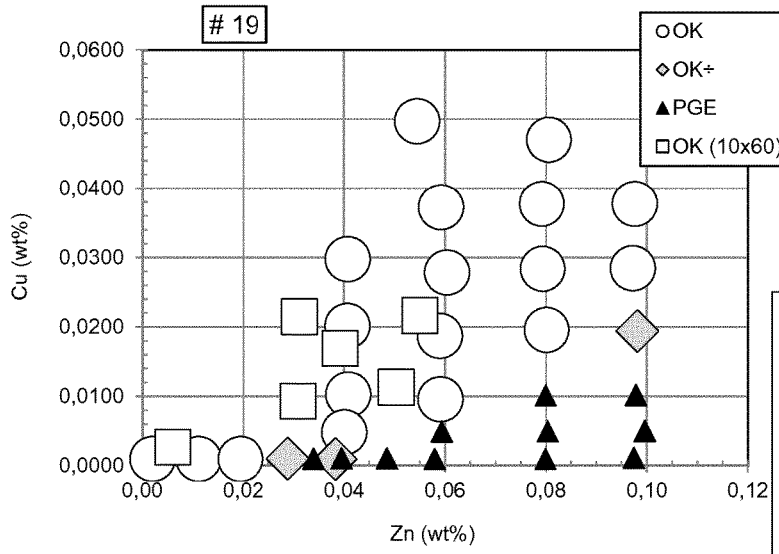

Figure 25
Trial 19 (+ Industrial verifying)
(Site B)
Ø95 + Ø203 mm billets
Profile cross section: 4 x 25 mm² and 10 x 60 mm²

Industrial extrusions included (Ø203 mm billets and 10 x 60 mm² profile cross section, represented by squares)

Fig. 26

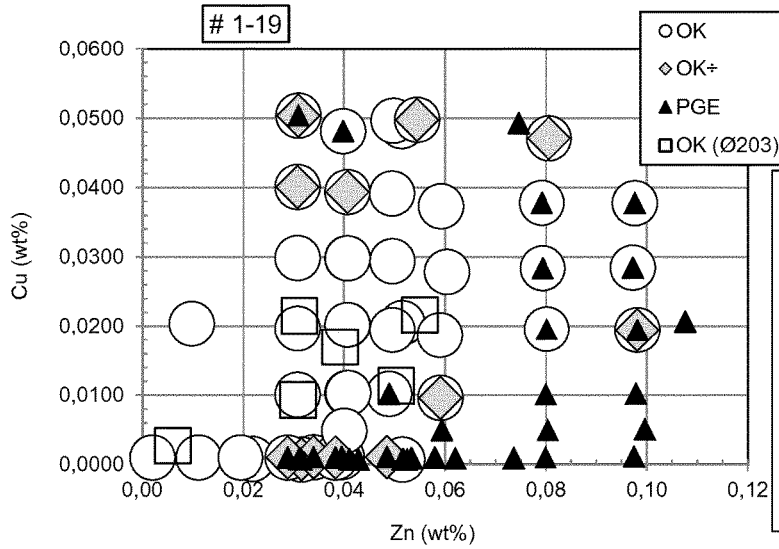

Figure 26
Summary of all 19 trials
(Sites A-J)
Ø95 + Ø203 mm billets
Profile cross sections: (2,9 x 65), (4 x 25) and (10 x 60) mm².

Industrial extrusions included (Ø203 mm billets and 10 x 60 mm² profile cross section, represented by squares)

ALUMINIUM EXTRUSION ALLOY SUITABLE FOR ETCHED AND ANODIZED COMPONENTS

The present application claims the benefit of priority of Norwegian patent application NO20151653, filed on Dec. 2, 2015 with the Norwegian Patent Office with the title "Aluminium extrusion alloy suitable for etched and anodized components", the entire content of which is incorporated herein by reference.

The present invention relates to an aluminum alloy suitable for etched and anodized components. More particularly the present invention relates mainly to extrusion alloys of the types MgSi, 6060 and 6063 which after being extruded to any wide variety of forms for different applications such as house buildings and other building applications, is subjected to etching and subsequent anodizing.

Due to environmental issues, it is foreseen that there will be an increased demand for re-melting post consumed aluminium products in the future. This may lead to somewhat higher levels of trace elements, like Zn in the re-melted metal, i.e. an enrichment over time.

Customers sometimes explicitly ask for recirculated aluminium, likely due to concern for the environment and reduced carbon footprint. It is therefore a prerequisite for metal suppliers to be able to handle such requests.

During normal alkaline etching prior to anodizing, it is experienced that some grains can be etched deeper than others, called "preferential grain etching" or "grainy" or "spangle appearance". Further, the gloss that is created by etching usually increases with increased Zn content in alloy.

Due to the etching of such materials, the Zn-content in the etching bath may be enriched and influence on the etching response as well. This may be avoided by using additives that precipitate the accumulated Zn-ions. There are several suppliers, promoting different proprietary additives (different amounts and types of chemicals) and they may give varying results.

Preferential grain etching (PGE) is caused by Zn in the alloy and/or in the etching bath as indicated above. Thus, it has been found that when alloys containing zinc with an amount in excess of 0.03 wt % are etched in a solution alkaline etching bath, these alloys tend to yield a "grainy" surface appearance.

Reliable measurement of free Zn-ions in the etching bath is normally done by ICP (Inductively Coupled Plasma Mass Spectrometry) which is a time consuming procedure and which has to be carried out by specialists. An easy and reliable measuring technique has not been established so far. An alternative remedy is to increase the use of additives on a regular basis for instance by adding sufficient $Na_2S$ in the etching tanks one day and then the etching tank is ready for use the next day or day thereafter.

An alternative method is to carry out mechanical pretreatment of the profile surface (shot blasting) such that the necessary time in the etch tank is reduced and the risk of preferential grain etching is reduced.

Still another alternative method that may be possible is the use of acid etch instead of alkaline etching bath. However, the use of acid in etch baths is encumbered with high risk of hazardous impact on the environments and persons involved in the etching bath operation and is not permitted in most western countries.

From U.S. Pat. No. 3,594,133 is known an etched article being made from an Al—Mg—Si alloy where the Cu/Zn ratio is required to be 1:1 on a weight basis ratio when the zinc content is in the range 0.03-0.10 wt % and 2:1 when the zinc content is above 0.10 wt %. Tests performed by the inventors of the present invention has proved, however, that the high content of copper does not prevent formation of PGE. Besides, the patent suggests high Cu content, which is harmful in relation to the corrosion resistance of the alloy and high Zn content which increases the Zn content of the etching bath and which in turn causes increased PGE.

The 6060 alloys contain according to the international AA standard 0.30-0.6 wt % Si, 0.10-0.30 wt % Fe, max 0.10 wt % Cu, max 0.10 wt % Mn, 0.35-0.6 wt % Mg, max 0.05 wt % Cr, max 0.15 wt % Zn and max 0.10 wt % Ti, others each max 0.05 wt % and others total max 0.15 wt %. The 6063 alloys contains according to the AA standard on the other hand 0.20-0.6 wt % Si, max 0.35 wt % Fe, max 0.10 wt % Cu, max 0.10 wt % Mn, 0.45-0.9 wt % Mg, max 0.10 wt % Cr, max 0.10 wt % Zn and max 0.10 wt % Ti, others each max 0.05 wt % and others total max 0.15 wt %.

With the present invention is provided a selection alloy solution where the Zn and Cu alloying elements of the 6060 and 6063 types of alloys, based on extensive testing in many experiments, are controlled to obtain the desired and consistent, optimal gloss and PGE appearance of such alloys.

The invention provides an alloy according to claim 1. Further embodiments of the invention are described in the dependent claims, which describe preferred sub-ranges that result in alloys with favorable properties.

The Cu and Zn ranges in the claims are described by an area/polygon in the Cu—Zn diagram. The claimed ranges lie within the area that is obtained by drawing straight lines between the points in ascending order (e.g. a straight line from a1 to a2, a straight line from a2 to a3, etc.) and further a straight line between the last and the first point (e.g. a straight line from a6 to a1). The points and lines itself limit the area and are not a part of the claimed area. That is, the alloys according to the invention comprise at least a small amount of Zn and a small amount of Cu. Further, if for example an area is partially defined by a straight line drawn from a point corresponding to 0.025 wt-% Cu and 0.025 wt-% Zn to a point corresponding to 0.05 wt-% Cu and 0.05 wt-% Zn, said area does not include alloys having a ratio of Cu/Zn equal to 1, but for example only includes alloys having a ratio of Cu/Zn below 1. When a dependent claims refers to points (e.g. a1 and a5) mentioned in a claim to which said dependent claim refers (e.g. a1, a2, a3, a4, a5), these points are redefined by the dependent claim and the relevant area is formed by these redefined points (e.g. a1 and a5) together with the points mentioned in the claim from which said dependent claim is dependent and which are not redefined (e.g. a2, a3, a4). When a dependent claim introduces a new set of points (points with a new index letter such as b1, b2, b3, b4), said claim is directed to said smaller/narrower area defined by said new set of points (such as b1, b2, b3, b4) unless it is indicated otherwise. FIG. 28 shows exemplary Cu—Zn ranges according to the invention.

A particularly robust alloy resistant to PGE and having good properties may be obtained when the Cu—Zn content of an alloy according to claim 1 is held within the composition window defined by points f1, f2, f3 and f4 in a Cu—Zn diagram, wherein f1 corresponds to 0.017 wt-% Cu and 0.025 wt-% Zn, f2 corresponds to 0.04 wt-% Cu and 0.07 wt-% Zn, f3 corresponds to 0.03 wt-% Cu and 0.07 wt-% Zn, and f4 corresponds to 0.007 wt-% Cu and 0.025 wt-% Zn. As is described herein (see e.g. also FIG. 26), good properties with respect to PGE have also been obtained when the alloy according to claim 1 comprises Cu and Zn in the composition window defined by points f1, f2, f3 and f4 as described in the sentence before, but has a minimum Zn concentration of more than 0.04 wt-% Zn. In other words, good properties with respect to PGE have been found when the Cu and Zn content of an alloy according to claim 1 is within the composition window defined by points f1*, f2*, f3* and f4* in the Cu—Zn diagram, wherein f1* corresponds to (approximately) 0.025 wt-% Cu and 0.04 wt-% Zn, f2* (equal to f2) corresponds to 0.04 wt-% Cu and 0.07 wt-% Zn, f3* (equal to f3) corresponds to 0.03 wt-% Cu and 0.07 wt-% Zn, and f4* corresponds to (approximately) 0.015 wt-% Cu and 0.04 wt-% Zn.

The invention will be further described in the following by way of example and with reference to the figures where;

FIG. 1 shows a photomicrograph of a 6063 aluminum alloy where preferential grain etching (PGE) is caused by Zn in the alloy ("The surface treatment and finishing of aluminum and its alloys", S. Wernick et al, Fifth Edition, Finishers Publishers Ltd.), FIGS. 2-8 show each SEM micrographs of a first series of extruded and anodized 6xxx alloys together with a vertical bar chart depicting the concentrations of Fe, Zn and Cu as well as images of anodised samples.

FIGS. 9-12 show each SEM micrographs of a second series of extruded and anodized 6xxx alloys together with a vertical bar chart representing the concentrations of Zn and Cu as well as images of anodised samples, FIG. 13 shows a summary of developed or avoided PGE on extruded and anodized 6xxx alloys with different concentrations of Cu and Zn based on Experiments 1 and 2.

FIG. 14*a* shows a table summarizing conditions and results of Experiments 1, 2 and 3.

FIG. 14*b* shows alloy compositions of samples used in Experiments 1, 2 and 3.

FIGS. 15-26 show detailed results of trials conducted for Experiments 1, 2 and 3.

Figure 1:
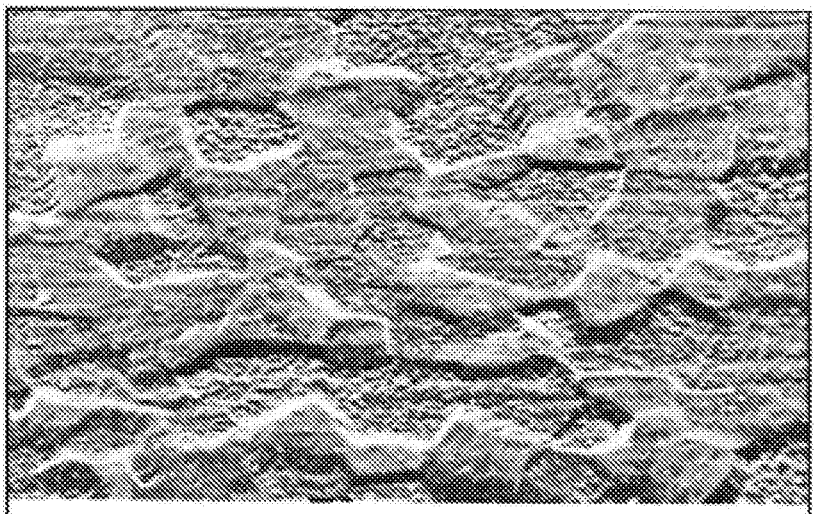

As stated above the present invention relates to aluminum alloys and particularly aluminium extrusion alloys of the types containing Magnesium and Silicon, 6060 and 6063 which after being extruded to any wide variety of forms for different applications such as house buildings and other building applications, is subjected to etching and subsequent anodizing. During normal alkaline etching prior to anodizing, it is experienced that some grains can be etched deeper than others, called "preferential grain etching" (PGE) or "grainy" or "spangle appearance". FIG. 1 shows a micrograph where such etching is depicted.

Extensive testing has been performed to arrive at an alloy composition where the Zn and Cu alloying elements are controlled to obtain the desired gloss and PGE. The alloy according to an embodiment of the invention may contain as follows in wt %: Si: 0.20-0.90, Mg: 0.30-0.90, Fe: 0.10-0.40, Mn: max 0.20, Zn: 0.025-0.10, Cu: 0.005-0.05, Ti: max 0.10, Cr: max 0.10, where the relation between Cu and Zn is controlled to avoid preferential grain etching and the ratio of Cu/Zn is below 1, including others or incidental impurities each in the amount of 0.05 wt % max, the total of others and impurities being in the amount of 0.15 wt % max and balance Al.

In this respect, the invention may according to a first exemplary aspect provide an aluminium alloy suitable for etched and anodized components, in particular aluminum extrusion alloys of the types containing Magnesium and Silicon, which after being extruded to any wide variety of forms for different applications such as house buildings and other building applications is subjected to etching in a conventional alkaline etching bath and subsequent anodizing, consisting of in wt %: Si: 0.20-0.90, Mg: 0.30-0.90, Fe: 0.10-0.40, Mn: max 0.20, Zn: 0.025-0.10, Cu: 0.005-0.05,Ti: max 0.10, Cr: max 0.10, where the relation between Cu and Zn is controlled to avoid preferential grain etching and the ratio of Cu/Zn is below 1, including others or incidental impurities each in the amount of 0.05 wt % max, the total of others and impurities being in the amount of 0.15 wt % max and balance Al.

According to a second exemplary aspect, the alloy according to the first aspect may be a 6060 or 6063 alloy according to the International AA alloy standard but where the concentration of Cu is between 0.005 and 0.05 wt % and the concentration of Zn is between 0.025 and 0.10 wt %.

According to a third exemplary aspect, the alloy according to the first or second aspect may be characterized in that the minimum concentration of Cu is 0.010 wt %.

According to a fourth aspect, the alloy according to any of the first to third aspect may be characterized in that the maximum concentration of Cu is 0.04 wt %.

According to a fifth exemplary aspect, the alloy according to any of the first to third aspect may be characterized in that the maximum concentration of Cu is 0.03 wt %.

According to a sixth aspect, the alloy according to any of the first to third aspect may be characterized in that the maximum concentration of Cu is 0.025 wt %.

According to a seventh exemplary aspect, the alloy according to any of the first to sixth aspect may be characterized in that the minimum concentration of Zn is 0.030 wt %. According to an eight exemplary aspect, the alloy according to any of the first to seventh aspect may be characterized in that the maximum concentration of Zn is 0.08 wt %.

According to a ninth exemplary aspect, the alloy according to any of the first to seventh aspect may be characterized in that the maximum concentration of Zn is 0.06 wt %.

According to a tenth exemplary aspect, the alloy according to any of the first to seventh aspect may be characterized in that the maximum concentration of Zn is 0.055 wt %. According to an eleventh exemplary aspect, the alloy according to any of the first to seventh aspect may be characterized in that the maximum concentration of Zn is 0.05 wt %. According to a twelfth exemplary aspect, the alloy according to any of the first to seventh aspect may be characterized in that the maximum concentration of Zn is 0.050 wt %.

According to a thirteenth exemplary aspect, the alloy according to any of the first to twelfth aspect may be characterized in that the ratio of Cu/Zn is between 0.8 and 0.2.

According to a fourteenth exemplary aspect, the alloy according to any of the first to twelfth aspect may be characterized in that the ratio of Cu/Zn is between 0.5 and 0.2.

According to a fifteenth exemplary aspect, the alloy according to any of the first to fourteenth aspect may be characterized in that the concentration of Fe is between 0.22 and 0.37 wt %.

According to a sixteenth exemplary aspect, the alloy according to any of the first to fifteenth aspect may be characterized in that the concentration of Mn is between 0.03 and 0.06 wt %.

According to a seventeenth exemplary aspect, the alloy according to any of the first to sixteenth aspect may be characterized in that the concentration of Mg is between 0.30 and 0.50 wt % and the concentration of Si is between 0.35 and 0.50 wt %.

EXAMPLE 1

The tests were initially carried out with alloys having a chemistry as defined in table 1 below. The concentrations of Si, Mg and Mn in these tested alloys are kept close to constant, while the concentrations of Fe and Zn are varied. To alloys 11, 12 and 17 it was added 0.05 wt % Cu.

TABLE 1

Chemistry of tested alloys and extrusions.

| Alloy | Si | Mg | Mn | Fe | Zn | Cu | Profile |
|---|---|---|---|---|---|---|---|
| 1 | 0.49 | 0.37 | 0.06 | 0.22 | 0.02 | 0.00 | A2-6 |
| 2 | 0.49 | 0.36 | 0.06 | 0.22 | 0.03 | 0.00 | A3-6 |
| 3 | 0.49 | 0.36 | 0.06 | 0.27 | 0.03 | 0.00 | A4-6 |
| 4 | 0.47 | 0.35 | 0.06 | 0.31 | 0.03 | 0.00 | A5-6 |
| 5 | 0.47 | 0.35 | 0.06 | 0.37 | 0.03 | 0.00 | A6-6 |
| 6 | 0.47 | 0.35 | 0.06 | 0.37 | 0.04 | 0.00 | A7-6 |
| 7 | 0.46 | 0.35 | 0.06 | 0.20 | 0.04 | 0.00 | A8-6 |
| 8 | 0.46 | 0.35 | 0.06 | 0.20 | 0.05 | 0.00 | A9-6 |
| 9 | 0.46 | 0.35 | 0.06 | 0.25 | 0.05 | 0.00 | A10-6 |
| 10 | 0.46 | 0.35 | 0.06 | 0.30 | 0.05 | 0.00 | A11-6 |
| 11 | 0.47 | 0.35 | 0.06 | 0.31 | 0.05 | 0.05 | A12-6 |
| 12 | 0.47 | 0.36 | 0.06 | 0.36 | 0.07 | 0.05 | A13-6 |
| 13 | 0.47 | 0.36 | 0.06 | 0.36 | 0.05 | 0.00 | A14-6 |
| 14 | 0.46 | 0.36 | 0.06 | 0.36 | 0.06 | 0.00 | A15-6 |
| 15 | 0.46 | 0.36 | 0.06 | 0.36 | 0.07 | 0.00 | A16-6 |
| 16 | 0.46 | 0.36 | 0.12 | 0.36 | 0.07 | 0.00 | A17-6 |
| >17 | 0.47 | 0.36 | 0.06 | 0.30 | 0.05 | 0.05 | A18-6 |
| >18 | 0.45 | 0.39 | 0.05 | 0.17 | 0.05 | 0.00 | A19-6 |

One log/billet of each alloy was, after casting, homogenized together (at the same time) with the following specified time-temperature path:

Heating rate 200-300° C./h to 575° C.

Holding at 575° C. for 2 hour and 15 minutes.

Then cooling at a cooling rate of 350° C./h.

After homogenisation the billets were extruded in an 800 tons vertical press with a container diameter of 100 mm and a billet length of 200 mm. Prior to extrusion the billets were preheated by induction heating at approximately 100° C./min to an average temperature 520° C. The container temperature was approximately 430° C. and the extrusion ratio was 78.5. The ram speed was 4.4 mm/s, while the profile speed was 22 m/m in. After extrusion, the profiles were air cooled to room temperature and then stretched to approximately 0.5% plastic strain. The extruded profiles were further aged (dual rate) as follows:

Heating from room temperature to 150: ~40 min.

Holding at 150° C. for approximately 30 min.

Heating from 150° C. to 195° C. at a rate of 15° C./h.

Time at final temperature 195° C., 2 hours.

The 18 newly extruded profiles were mounted horizontally and etched in an industrial 15000 litres NaOH etching bath with A18000 additive (commercially available product). The temperature was 70° C. and the etching time was 15 minutes. Finally, the etched profile samples were anodized, also in normal production.

Evaluation of Anodized Surfaces.

FIGS. 2-8 show as stated above SEM micrographs of the tested profile surfaces together with concentrations of Fe, Zn and Cu together with images of anodises samples.

Figure 2:
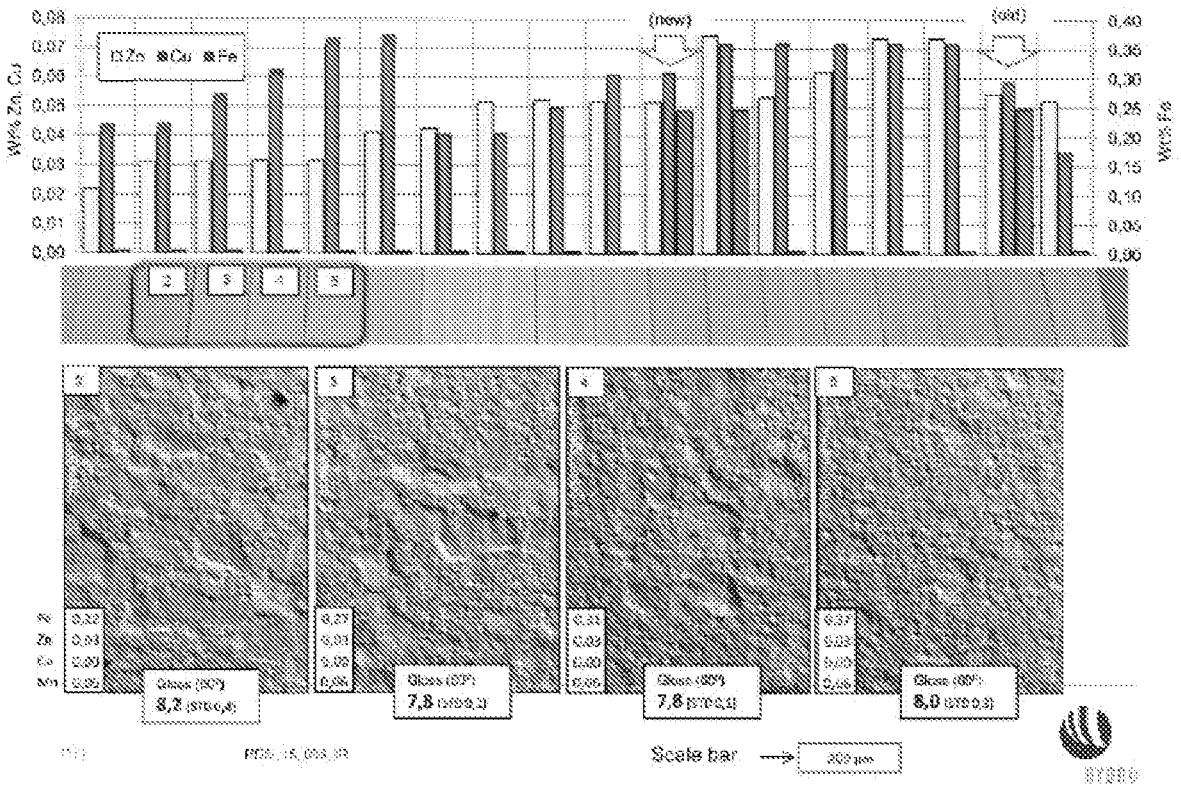
Figure 3:
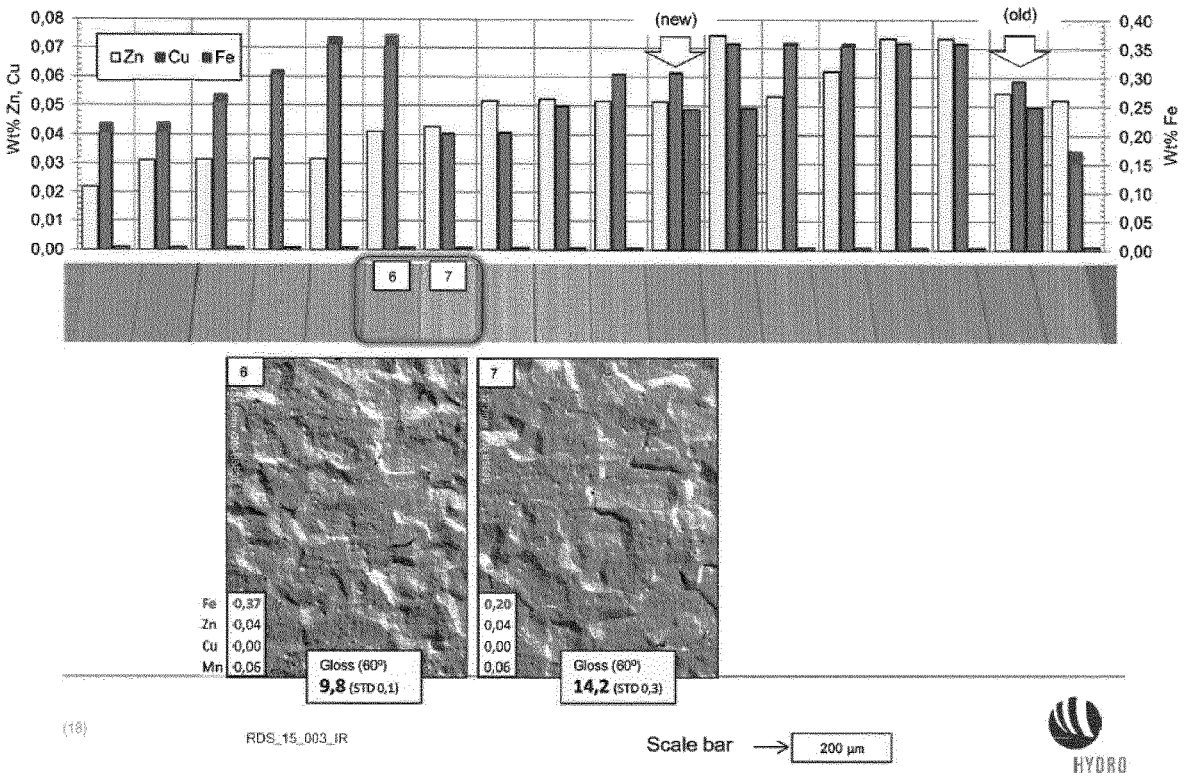
Figure 4:
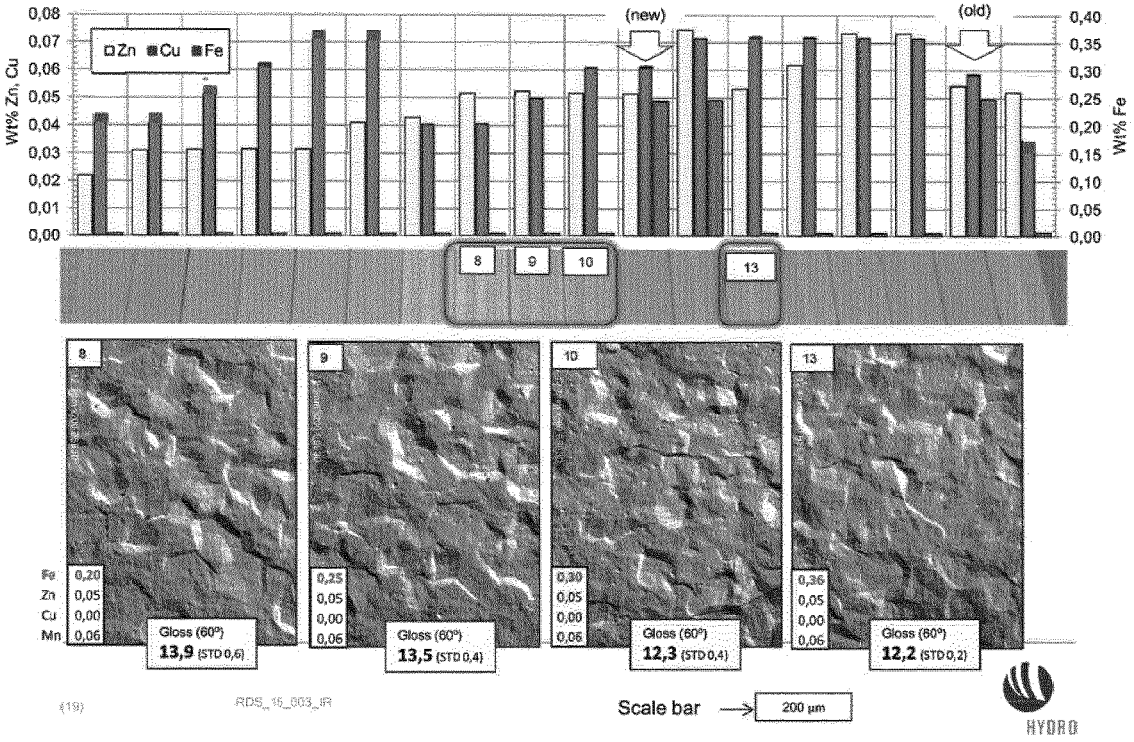

From FIGS. 2, 3 and 4 it appears that increasing Fe reduce the gloss values when the Zn content is more than 0.03 wt %. As is further apparent from FIG. 2, PGE is slightly reduced with increasing Fe from 0.22 to 0.37 wt %. At 0.04 wt % Zn and higher, FIGS. 3 and 4, the effect of increasing Fe on PGE is negligible.

Figure 5:
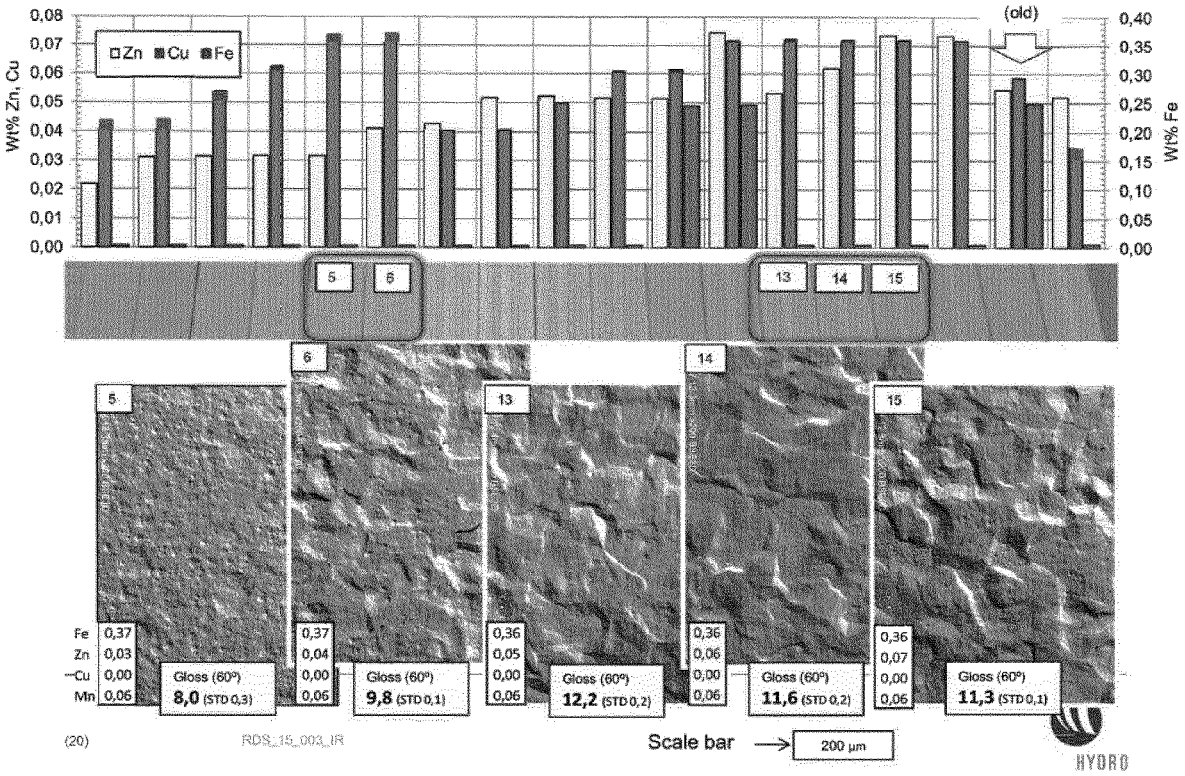
Figure 6:
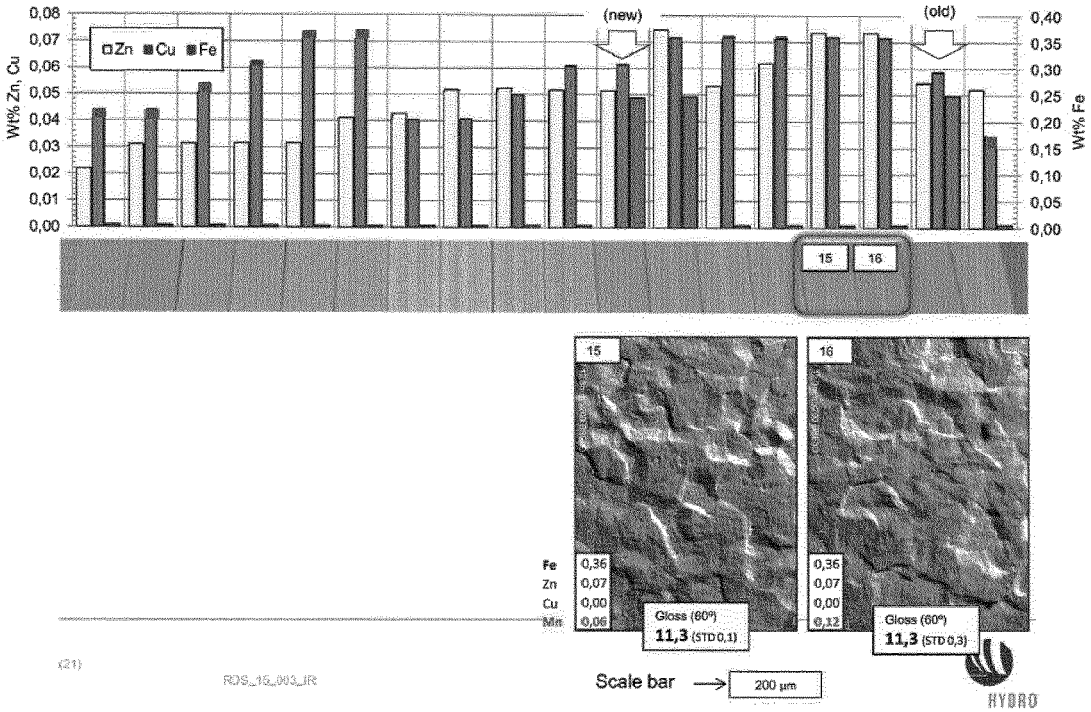
Figure 7:
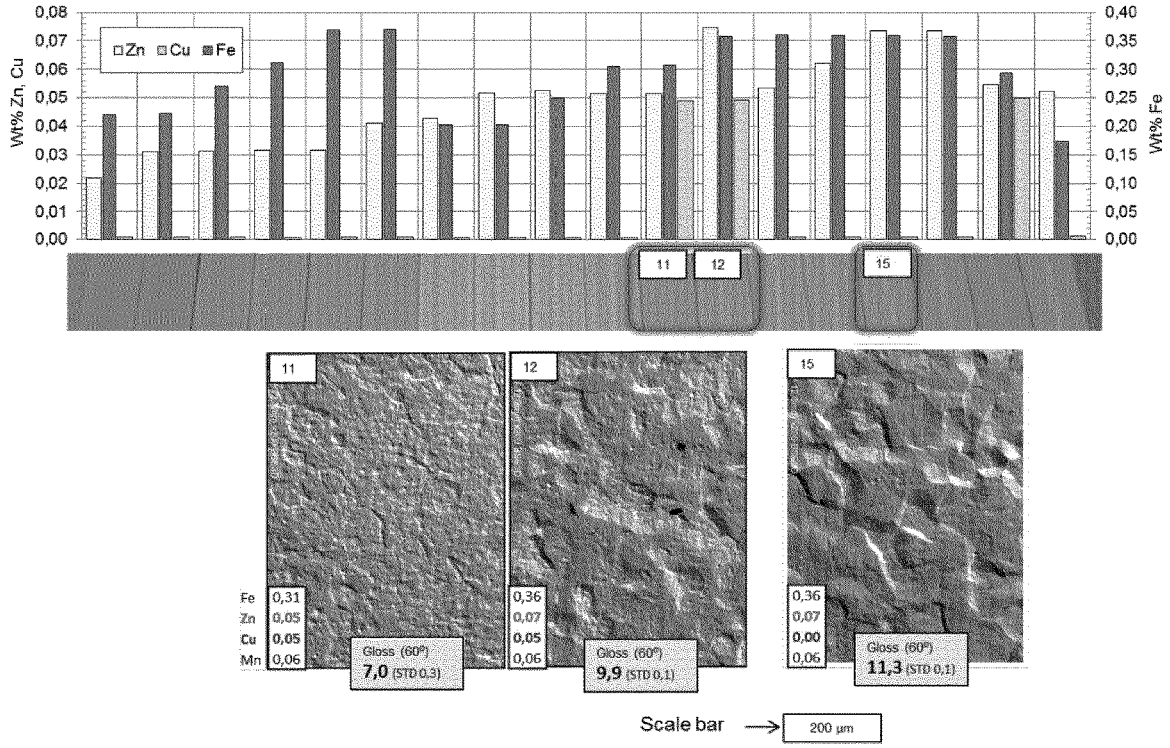

FIG. 6 shows that there is not observed any effect on gloss and PGE when increasing Mn from 0.06 to 0.12 wt %. Further, FIG. 5 shows that gloss is strongly increased when increasing Zn from 0.03 to 0.05 wt %, but gloss is slightly reduced when increasing Zn even higher, i.e. from 0.05 to 0.07 wt %.

Figure 8:
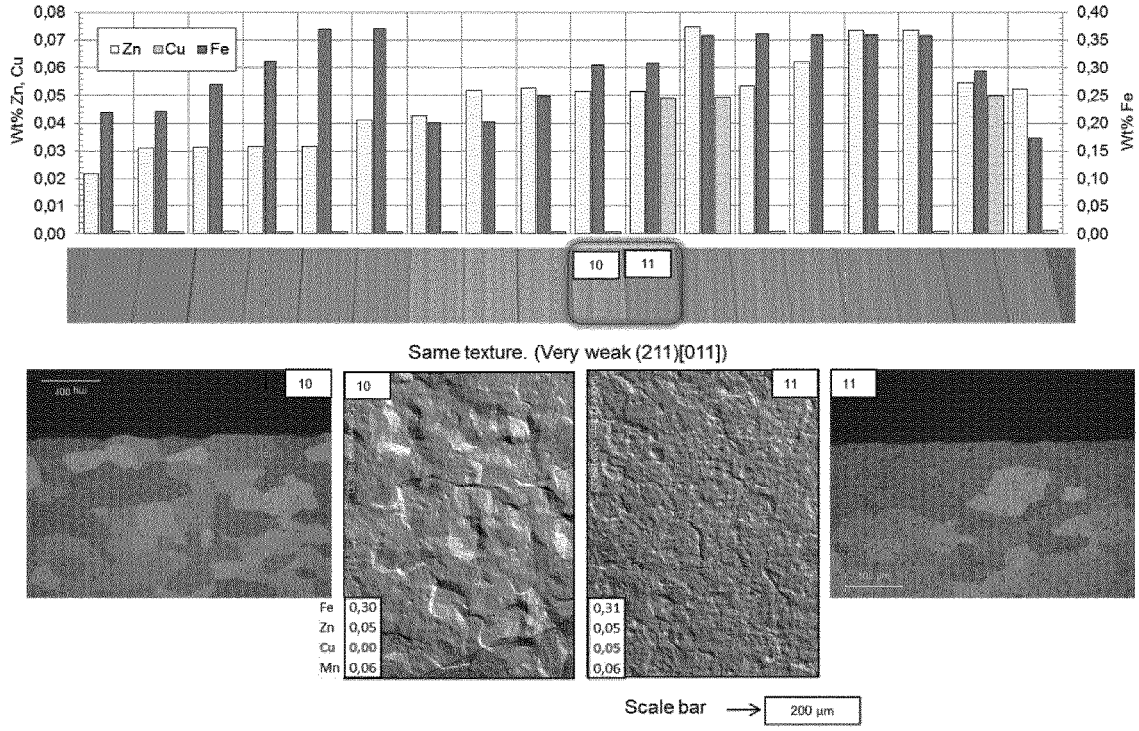

The effect of Cu on PGE and gloss is, however, remarkable when being added to the alloy containg 0.05 wt % Zn and 0.30 wt % Fe, as can be seen in FIG. 8. This effect is on the other hand not evident with higher Zn level, 0.07 wt % as is apparent from FIG. 7. FIG. 17 (Trial 11) shows an overview of the results obtained in Example 1.

Gloss was measured at an angle of 60° along the extrusion direction using a handheld measurement device.

The positive test results from the experiments that were done under Example 1 relating to the effect of Cu on alloys containg Zn led to the conclusion that further test should be done with alloys containing different ranges of Cu in relation to Zn. Such test were carried out under the following example.

EXAMPLE 2

Additional test were carried out on alloys with varying ranges of Cu and Zn concentrations as defined in the table below:

TABLE 2

Chemistry of tested alloys and extrusions with varying ranges of Cu and Zn concentrations.

| n = 4 | AVG Si | AVG Fe | AVG Cu | AVG Mn | AVG Mg | AVG Zn |
|---|---|---|---|---|---|---|
| B1 | 0.47 | 0.30 | 0.00 | 0.06 | 0.36 | 0.03 |
| B2 | 0.47 | 0.30 | 0.00 | 0.06 | 0.36 | 0.05 |
| B3 | 0.47 | 0.30 | 0.05 | 0.06 | 0.36 | 0.05 |
| B4 | 0.46 | 0.28 | 0.01 | 0.06 | 0.36 | 0.03 |
| B5 | 0.45 | 0.28 | 0.02 | 0.06 | 0.36 | 0.03 |
| B6 | 0.46 | 0.28 | 0.03 | 0.06 | 0.36 | 0.03 |
| B7 | 0.46 | 0.28 | 0.04 | 0.06 | 0.36 | 0.03 |
| B8 | 0.46 | 0.28 | 0.05 | 0.06 | 0.35 | 0.03 |
| B9 | 0.46 | 0.26 | 0.01 | 0.06 | 0.35 | 0.04 |
| B10 | 0.46 | 0.26 | 0.02 | 0.06 | 0.35 | 0.04 |
| B11 | 0.46 | 0.26 | 0.03 | 0.06 | 0.35 | 0.04 |
| B12 | 0.46 | 0.27 | 0.04 | 0.06 | 0.34 | 0.04 |
| B13 | 0.45 | 0.26 | 0.05 | 0.06 | 0.33 | 0.04 |
| B14 | 0.46 | 0.28 | 0.01 | 0.06 | 0.36 | 0.05 |
| B15 | 0.46 | 0.28 | 0.02 | 0.06 | 0.35 | 0.05 |
| B16 | 0.46 | 0.28 | 0.03 | 0.06 | 0.36 | 0.05 |
| B17 | 0.46 | 0.28 | 0.04 | 0.06 | 0.35 | 0.05 |
| B18 | 0.46 | 0.28 | 0.05 | 0.06 | 0.35 | 0.05 |

As can be seen from Table 2, the concentrations of Si, Mg, Fe and Mn are basically kept the same for all of the alloys, while the concentrations of Cu and Zn are varied. The alloys as defined in table 2 were cast, heat treated, extruded to profiles, stretched, aged, etched and anodized the same way and under the same conditions as under example 1 above.

The initial three alloys in Table 2, B1, B2 and B3, correspond respectively to alloys A4, A10 and A11 in Table 1 above from example 1 and are included in the alloy matrix as reference material.

Figure 9:
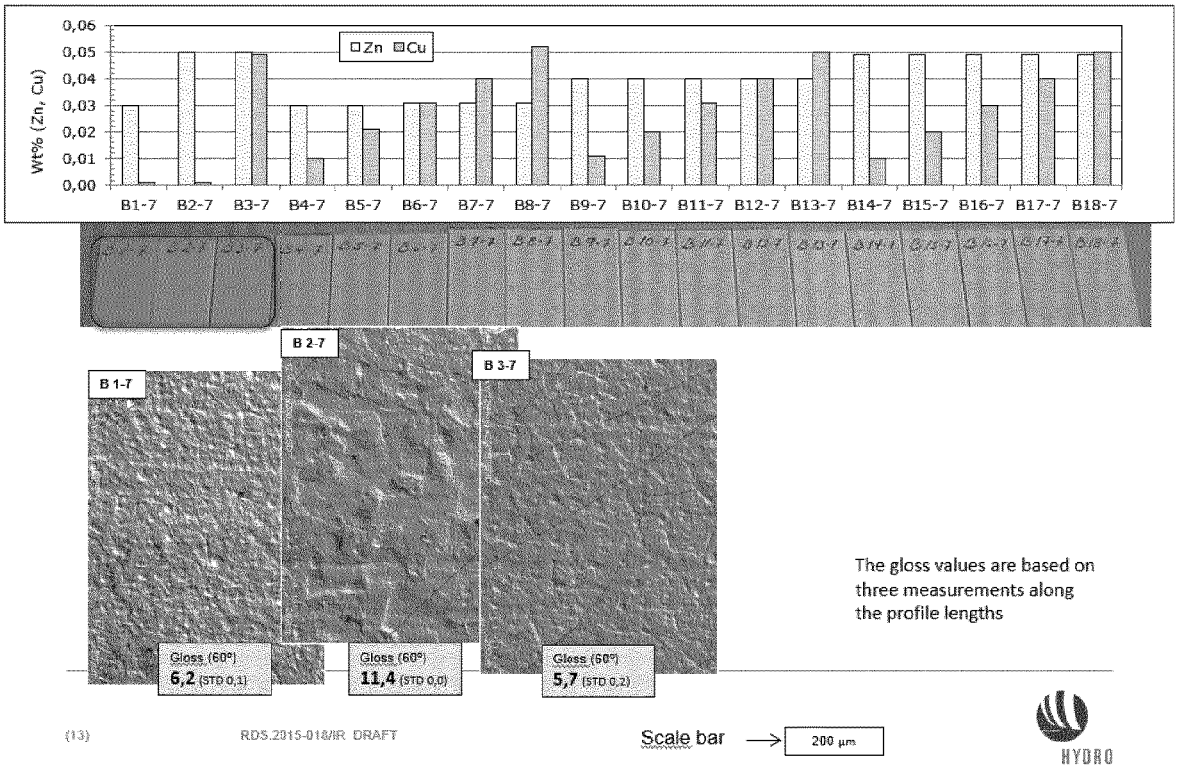
Figure 10:
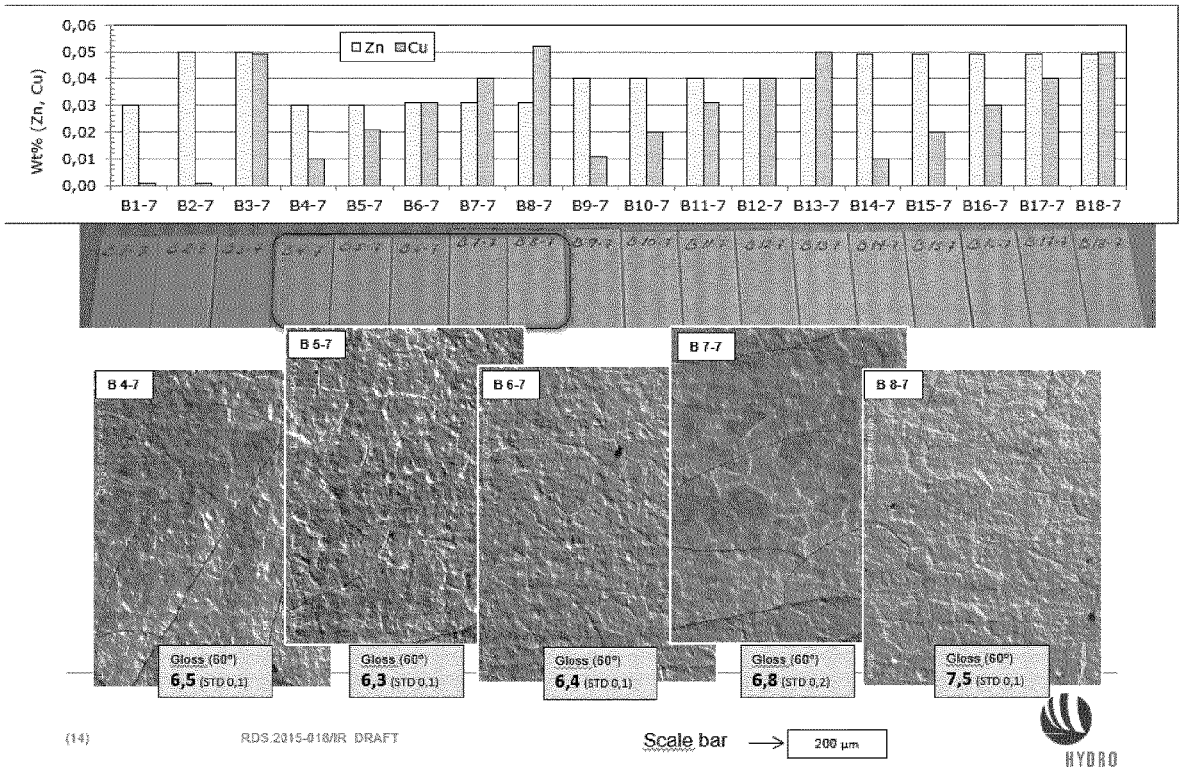
Figure 11:
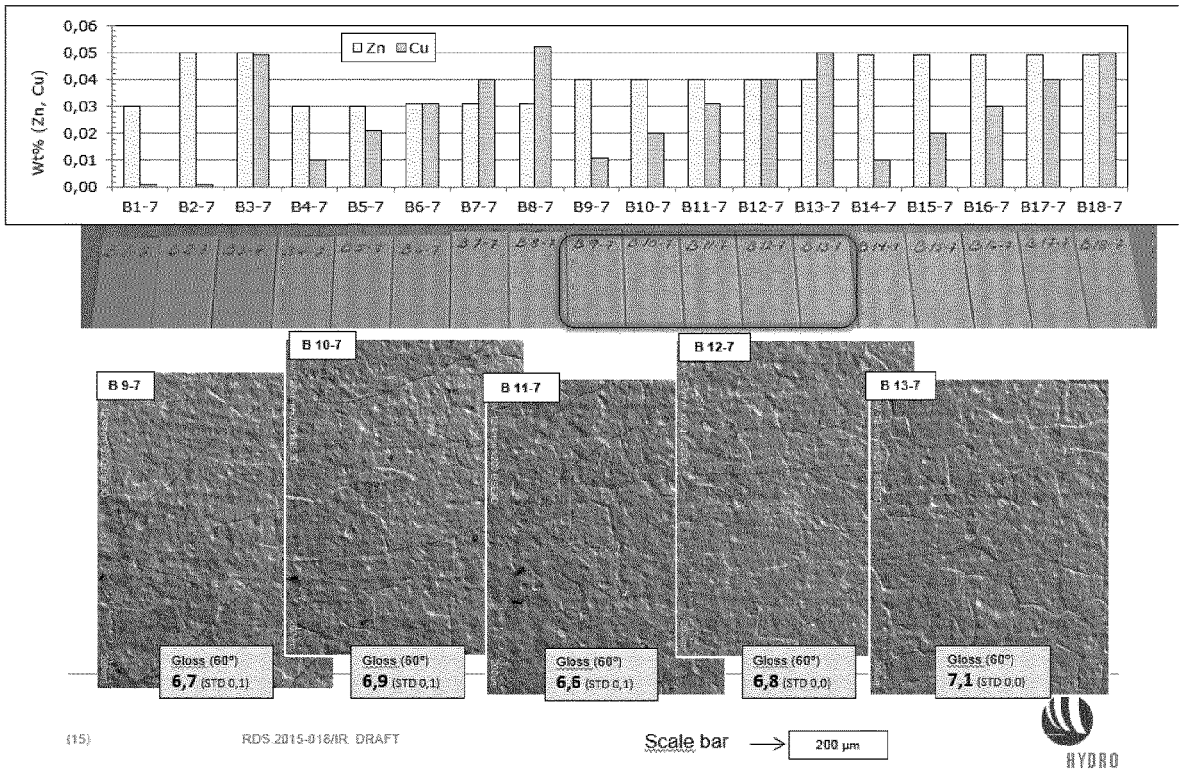
Figure 12:
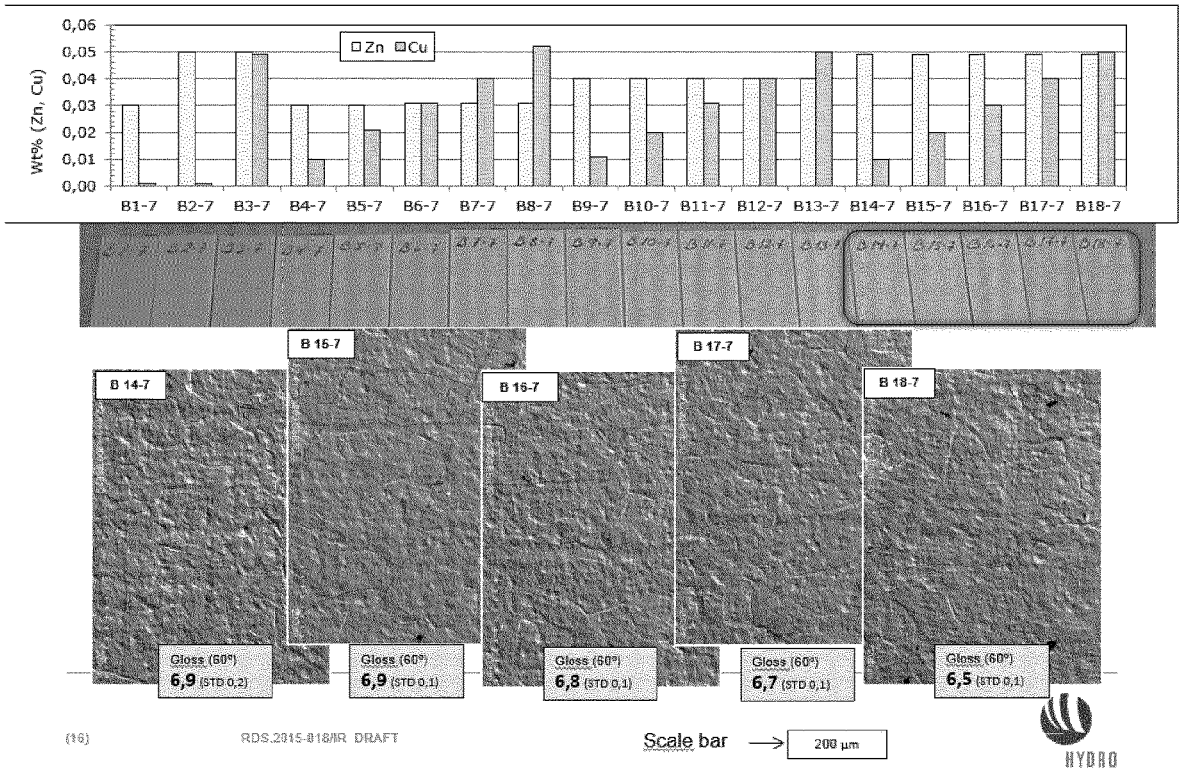

FIG. 9 shows micrographs of profiles of these former tested alloys B1, B2 and B3 together with diagrams showing the Cu and Zn concentrations and as can be clearly seen from this figure, the PGE is vastly reduced or absent with the addition of 0.05 wt % Cu.

FIGS. 9, 10, 11 and 12 shows SEM micrographs together with diagrams showing the Cu and Zn concentrations for each respective depiction. The results as shown in these figures confirm the observations under the initial tests as commented in Example 1 above that addition of Cu reduces gloss and PGE on Zn containing 6060 and 6063 types alloys. Further, FIGS. 18 to 22 show an overview of the surface qualities obtained in Example 2.

Based on the tests under the examples above it has been possible to optimize the addition of Cu in relation to Zn to obtain the desired reduced gloss and PGE as defined in the claims. On the other hand, the content of Cu should be as low as possible to reduce the possibility of corrosion, even below 0.010 wt %. Further, the content of Zn should not be too high, since for example it may result in accumulation of Zn in the etching bath, which in turn results in higher risk for PGE.

Figure 13:
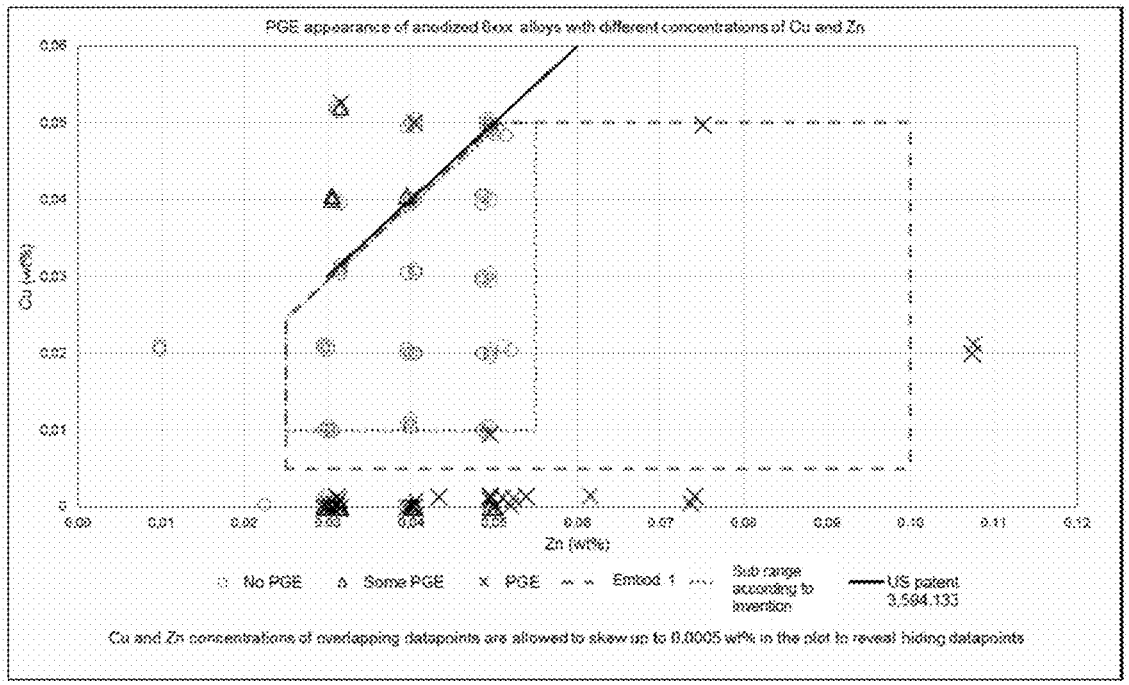
Figure 19:
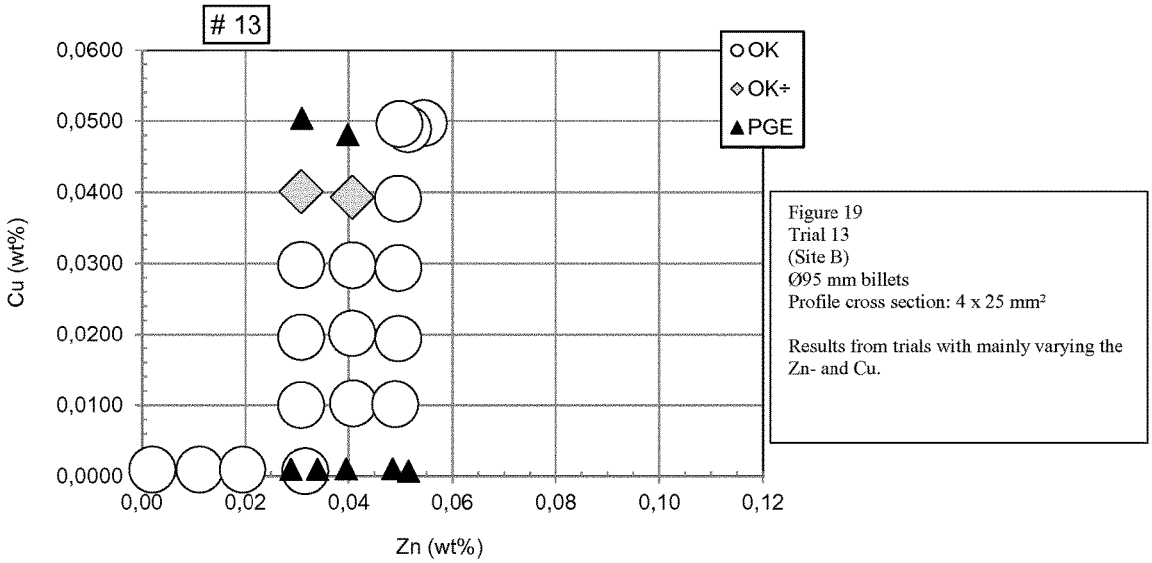
Figure 20:
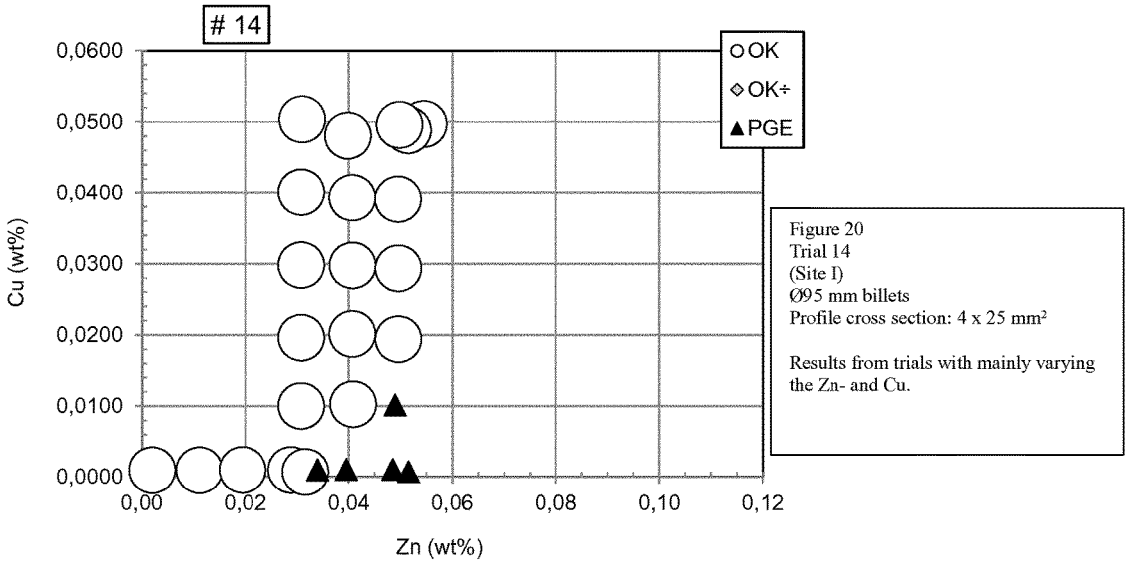

FIG. 13 shows as formerly stated a summary of 6xxx alloys with different concentrations of Cu and Zn in relation to visual observation of developed PGE on the surface during the anodizing process. The circular spots are observed, tested surfaces where the degree of PGE is low and well within acceptable level, while the crosses are observations where the PGE level is too high and not acceptable. Based on the observations as depicted in FIG. 13, the frame drawn up by dotted lines shows the scope of protection, i.e. the area within the Cu, Zn diagram showing which levels or which combinations of Zn and Cu where PGE is not developed for the subject 6xxx alloys that have been tested. Thus, it is clearly shown in FIG. 13 that PGE is within an acceptable level if Cu is below 0.05 wt % and Zn below 0.10 wt % and the ratio of Cu/Zn is below 1.

EXAMPLE 3

Further experiments have been carried out on alloys with varying ranges of Cu and Zn concentrations as defined in the table shown in FIG. 14*a*. The experiments have been conducted in different locations A, B, C, D, E, F, G, H and I as is apparent from the table. In this respect, each location represents a geographically separate facility. As is further apparent from FIG. 14*a*, the tests were carried out using different billet diameters and profile cross sections that were prepared similar to the procedure described for Experiment 1. Further, FIG. 14*b* shows the chemical compositions of the samples mentioned in the table of FIG. 14*a*. The samples mentioned in FIG. 14*a* are identifiable in FIG. 14*b* by their cast name and by their Cu and Zn compositions. As is apparent, the samples were either air cooled or water quenched ("Water Q") after extrusion.

The samples were then analyzed as described above and the results are shown in FIGS. 15, 16, 23, 24 and 25 as well as in the table shown in FIG. 14*a*. FIG. 26 shows a combined view of the obtained results of all experiments 1, 2 and 3. FIG. 13 shows a subset of the data shown in FIG. 26. In this respect, in FIGS. 15 to 27, "OK" indicates a good surface quality with no PGE and good optical properties. Further, "OK-" indicates an acceptable surface quality potentially with light PGE and optical properties that are acceptable for several applications, and "PGE" indicates that more severe PGE occurred that resulted in a surface quality that is considered to be insufficient but might still be acceptable depending on the use environment in some cases.

As can be seen, there are slight variations for the same samples depending on the location in which the trial was conducted. There are further slight variations for the same sample and the same location when a trial was repeated. It is assumed that these differences are caused by slight process variations that cannot be accounted for by current process control, such as variations of conditions in the etching bath. Environmental conditions such as humidity and temperature may also influence the results.

Accordingly, embodiments of the present invention define composition ranges that allow an efficient production of efficient alloys for etching and/or anodizing and give consistent results even when the process parameters, that cannot be efficiently controlled by production means, fluctuate.

Figure 27:
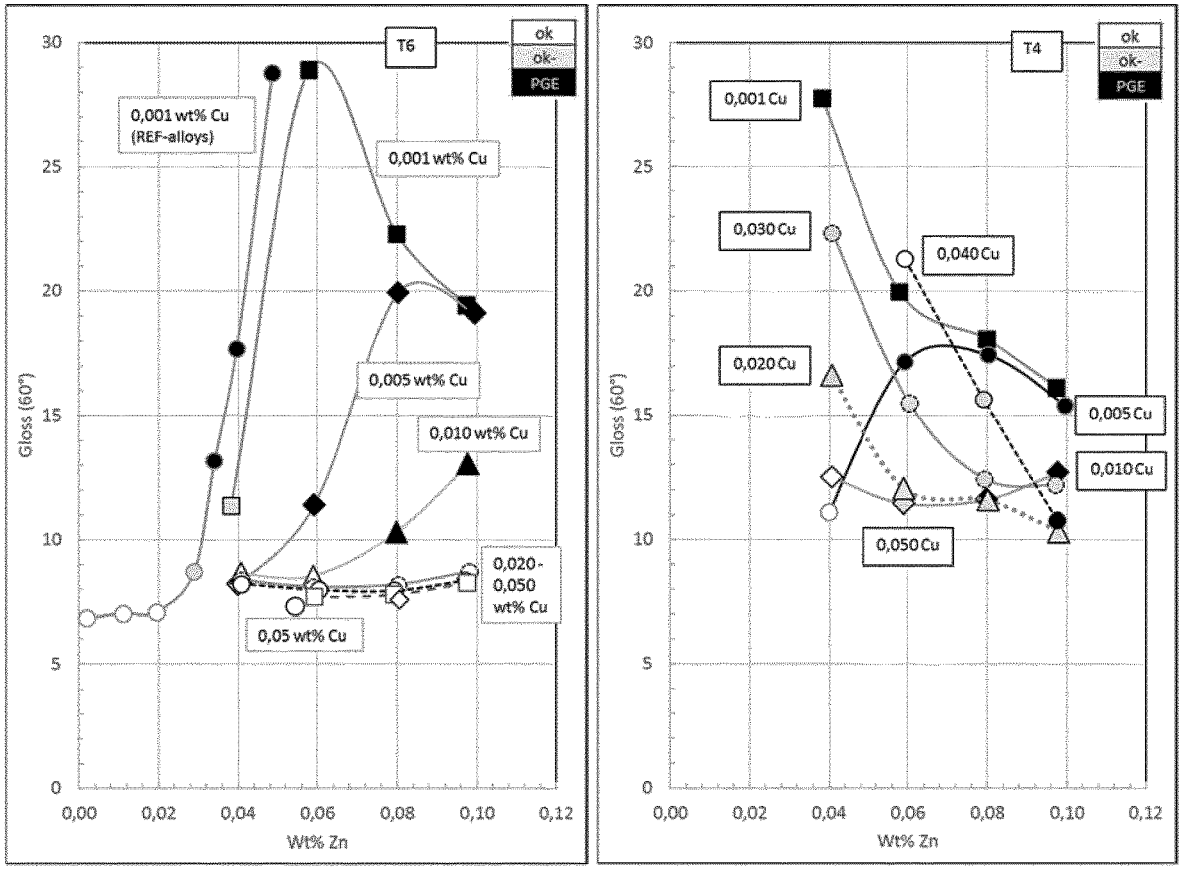
FIG. 27 shows a relationship between temper condition and preferential grain etching.
Figure 28:
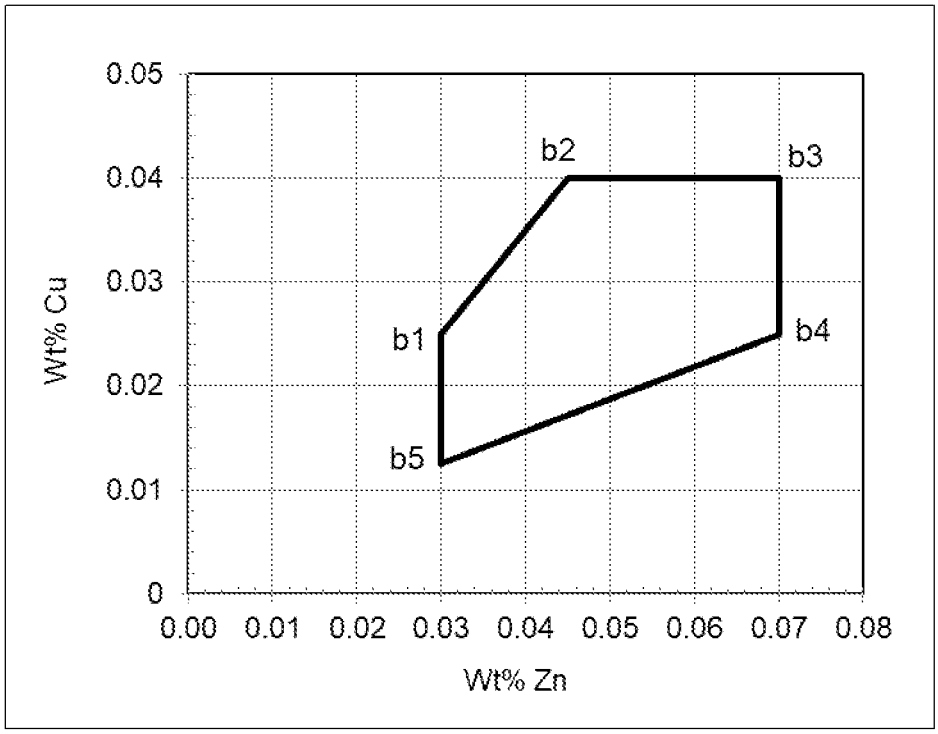
FIG. 28 is a chart of the composition ranges of a first embodiment of the alloy composition.
Figure 29:
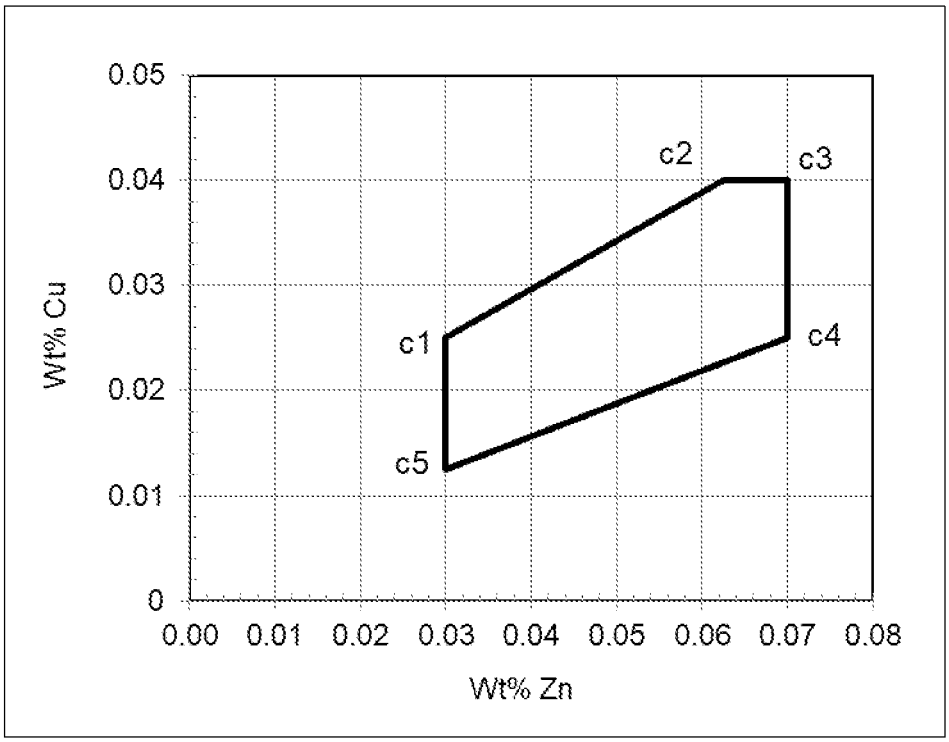
FIG. 29 is a chart of the composition ranges of a second embodiment of the alloy composition.
Figure 30:
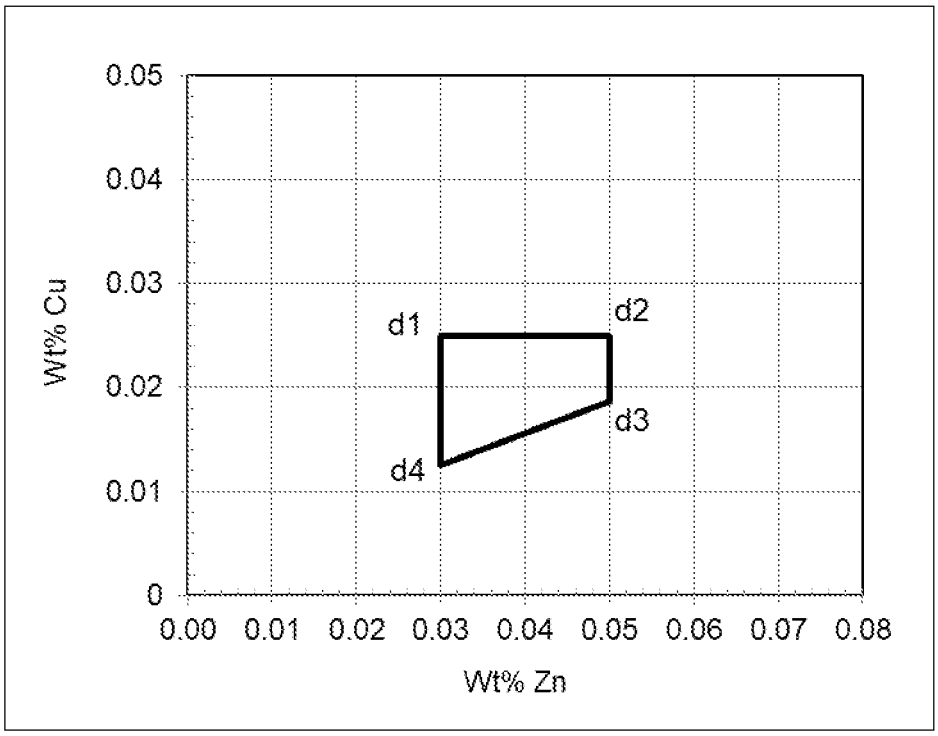
FIG. 30 is chart of the composition ranges of a third embodiment of the alloy composition.
Figure 31:
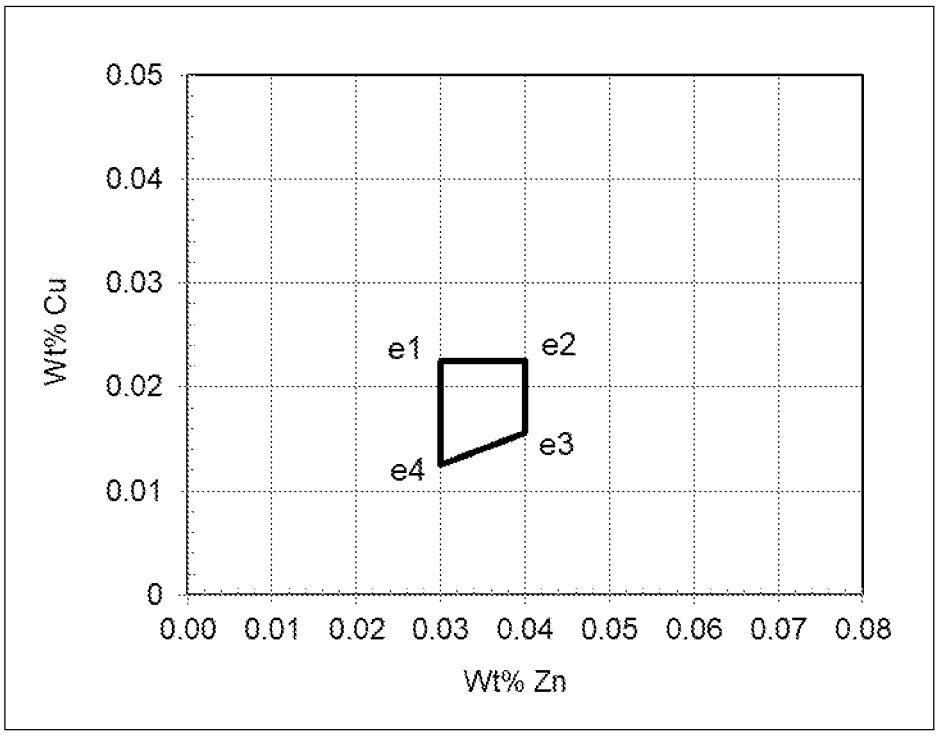
FIG. 31 is a chart of the composition ranges of a fourth embodiment of the alloy composition.
Figure 32:
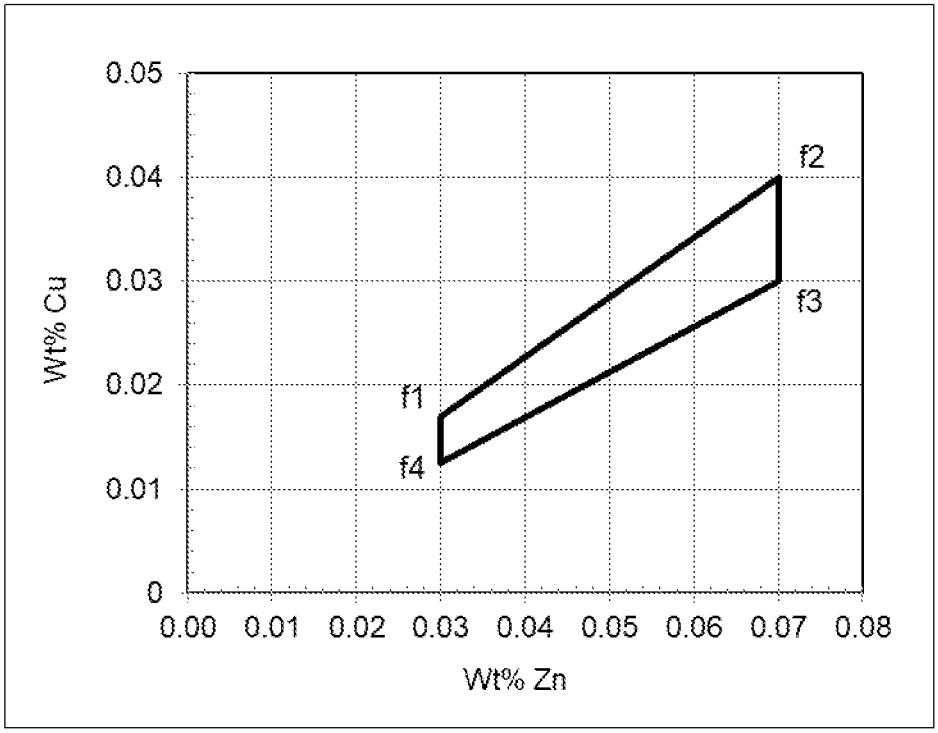
FIG. 32 is a chart of the composition ranges of a fifth embodiment of the alloy composition.

Further tests have been carried out with alloys in different temper conditions as shown in FIG. 27. It has been found that if the material is in T1 or T4 temper condition, a relation between Zn and PGE is no longer apparent, and the alloys also generally exhibit higher susceptibility for PGE (right view in FIG. 27). Accordingly, the alloys and products according to the invention may be characterized by having a temper condition other than T1 or T4, e.g. by having a temper condition selected from: T2, T3, T5, T6, T7, T8, T9 or T10.

The invention claimed is:

1. An aluminium alloy suitable for etched and anodized components, comprising in wt %:

Si: 0.20-0.90
Mg: 0.30-0.90
Fe: 0.10-0.40
Mn: 0.03-0.20,
Ti: max 0.10,
others and/or incidental impurities each in the amount of 0.05 wt % max,
wherein the total of others and the incidental impurities is 0.15 wt % max, and
a balance of Al,
wherein the aluminium alloy further comprises Cu and Zn in a Cu/Zn ratio of below 1, thereby reducing instances of preferential grain etching when the aluminium alloy is extruded into an extruded product that is etched and anodized,
wherein the content of Cu and Zn of the aluminium alloy in wt-% is inside the composition range described by the area defined by points b1, b2, b3, b4, and b5 of Cu—Zn diagram, wherein
b1 corresponds to 0.025 wt-% Cu and 0.03 wt-% Zn,
b2 corresponds to 0.04 wt-% Cu and 0.045 wt-% Zn,
b3 corresponds to 0.04 wt-% Cu and 0.07 wt-% Zn,
b4 corresponds to 0.025 wt-% Cu and 0.07 wt-% Zn, and
b5 corresponds to 0.0125 wt-% Cu and 0.03 wt-% Zn, and
wherein, when the aluminium alloy is extruded into an extruded product that is etched and anodized, the extruded product has a gloss value of 5.7 or higher when measured at an angle of 60° along an extrusion direction.

2. The aluminium alloy according to claim 1, wherein the content of Cu and Zn of the aluminium alloy in wt-% is inside the composition range described by the area defined by points c1, c2, c3, c4, and c5 of a Cu—Zn diagram, wherein c1 corresponds to 0.025 wt-% Cu and 0.03 wt-% Zn,
c2 corresponds to 0.04 wt-% Cu and 0.0625 wt-% Zn,
c3 corresponds to 0.04 wt-% Cu and 0.07 wt-% Zn,
c4 corresponds to 0.025 wt-% Cu and 0.07 wt-% Zn, and
c5 corresponds to 0.0125 wt-% Cu and 0.03 wt-% Zn.

3. The aluminium alloy according to claim 1, wherein the content of Cu and Zn of the aluminium alloy in wt-% is inside the composition range described by the area defined by points d1, d2, d3, and d4 of a Cu—Zn diagram, wherein d1 corresponds to 0.025 wt-% Cu and 0.03 wt-% Zn,
d2 corresponds to 0.025 wt-% Cu and 0.05 wt-% Zn,
d3 corresponds to 0.01875 wt-% Cu and 0.05 wt-% Zn, and
d4 corresponds to 0.0125 wt-% Cu and 0.03 wt-% Zn.

4. The aluminium alloy according to claim 3, wherein the content of Cu and Zn of the aluminium alloy in wt-% is inside the composition range described by the area defined by points e1, e2, e3, and e4 of a Cu—Zn diagram, wherein
e1 corresponds to 0.0225 wt-% Cu and 0.03 wt-% Zn,
e2 corresponds to 0.0225 wt-% Cu and 0.04 wt-% Zn,
e3 corresponds to 0.0156 wt-% Cu and 0.04 wt-% Zn, and
e4 corresponds to 0.0125 wt-% Cu and 0.03 wt-% Zn.

5. The aluminium alloy according to claim 1, wherein the content of Cu and Zn of the aluminium alloy in wt-% is inside the composition range described by the area defined by points f1, f2, f3, and f4 of a Cu—Zn diagram, wherein
f1 corresponds to 0.017 wt-% Cu and 0.03 wt-% Zn,
f2 corresponds to 0.04 wt-% Cu and 0.07 wt-% Zn,
f3 corresponds to 0.03 wt-% Cu and 0.07 wt-% Zn, and
f4 corresponds to 0.0125 wt-% Cu and 0.03 wt-% Zn.

6. The aluminium alloy according to claim 1, wherein the aluminium alloy comprises between 0.22 and 0.37 wt-% Fe.

7. The aluminium alloy according to claim 1, wherein the aluminium alloy comprises between 0.03 and 0.06 wt-% Mn.

8. The aluminium alloy according to claim 1, wherein the aluminium alloy comprises between 0.30 and 0.50 wt-% Mg and between 0.35 and 0.50 wt-% Si.

9. The aluminium alloy according to claim 1, made from Zn-containing aluminium alloy scrap pieces having different Zn concentrations.

10. An extruded product comprising an aluminium alloy suitable for etched and anodized components, comprising in wt %:
Si: 0.20-0.90,
Mg: 0.30-0.90,
Fe: 0.10-0.40,
Mn: 0.03-0.20,
Ti: max 0.10,
others and/or incidental impurities each in the amount of 0.05 wt % max,
wherein the total of the others and the incidental impurities is 0.15 wt % max, and a balance of Al,
wherein the aluminium alloy further comprises Cu and Zn in a Cu/Zn ratio of below 1, thereby reducing instances of preferential grain etching when the aluminium alloy is extruded into an extruded product that is etched and anodized,
wherein the content of Cu and Zn of the aluminium alloy in wt-% is inside the composition range described by the area defined by points b1, b2, b3, b4, and b5 of a Cu—Zn diagram, wherein
b1 corresponds to 0.025 wt-% Cu and 0.03 wt-% Zn,
b2 corresponds to 0.04 wt-% Cu and 0.045 wt-% Zn,
b3 corresponds to 0.04 wt-% Cu and 0.07 wt-% Zn,
b4 corresponds to 0.025 wt-% Cu and 0.07 wt-% Zn, and
b5 corresponds to 0.0125 wt-% Cu and 0.03 wt-% Zn, and
wherein the product is etched and anodized and has a gloss value of 5.7 or higher when measured at an angle of 60° along an extrusion direction.

11. The extruded product according to claim 10, wherein the extruded product has a temper condition other than T1 or T4.

12. The extruded product according to claim 10, wherein the extruded product has a gloss value of 7.0 or higher when measured at an angle of 60° along an extrusion direction.

13. The extruded product according to claim 10, wherein the content of Cu and Zn of the aluminium alloy in wt-% is inside the composition range described by the area defined by points c1, c2, c3, c4, and c5 of a Cu—Zn diagram, wherein
c1 corresponds to 0.025 wt-% Cu and 0.03 wt-% Zn,
c2 corresponds to 0.04 wt-% Cu and 0.0625 wt-% Zn,
c3 corresponds to 0.04 wt-% Cu and 0.07 wt-% Zn,
c4 corresponds to 0.025 wt-% Cu and 0.07 wt-% Zn, and
c5 corresponds to 0.0125 wt-% Cu and 0.03 wt-% Zn.

14. The extruded product according to claim 10, wherein the content of Cu and Zn of the aluminium alloy in wt-% is inside the composition range described by the area defined by points d1, d2, d3, and d4 of a Cu—Zn diagram, wherein
d1 corresponds to 0.025 wt-% Cu and 0.03 wt-% Zn,
d2 corresponds to 0.025 wt-% Cu and 0.05 wt-% Zn,
d3 corresponds to 0.01875 wt-% Cu and 0.05 wt-% Zn, and
d4 corresponds to 0.0125 wt-% Cu and 0.03 wt-% Zn.

15. The extruded product according to claim 10, wherein the content of Cu and Zn of the aluminium alloy in wt-% is inside the composition range described by the area defined by points e1, e2, e3, and e4 of a Cu—Zn diagram, wherein
e1 corresponds to 0.0225 wt-% Cu and 0.03 wt-% Zn,
e2 corresponds to 0.0225 wt-% Cu and 0.04 wt-% Zn,
e3 corresponds to 0.0156 wt-% Cu and 0.04 wt-% Zn, and
e4 corresponds to 0.0125 wt-% Cu and 0.03 wt-% Zn.

16. The extruded product according to claim 10, wherein the content of Cu and Zn of the aluminium alloy in wt-% is inside the composition range described by the area defined by points f1, f2, f3, and f4 of a Cu—Zn diagram, wherein
f1 corresponds to 0.017 wt-% Cu and 0.03 wt-% Zn,
f2 corresponds to 0.04 wt-% Cu and 0.07 wt-% Zn,
f3 corresponds to 0.03 wt-% Cu and 0.07 wt-% Zn, and
f4 corresponds to 0.0125 wt-% Cu and 0.03 wt-% Zn.

* * * * *